US006862013B2

(12) United States Patent
Takeuchi et al.

(10) Patent No.: US 6,862,013 B2
(45) Date of Patent: Mar. 1, 2005

(54) IMAGE DISPLAY DEVICE

(75) Inventors: Masanori Takeuchi, Taki-gun (JP); Nobuyoshi Nagashima, Matsusaka (JP); Naofumi Kondo, Nara (JP); Kazuyori Mitsumoto, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 557 days.

(21) Appl. No.: 09/909,169

(22) Filed: Jul. 11, 2001

(65) Prior Publication Data

US 2002/0011982 A1 Jan. 31, 2002

(30) Foreign Application Priority Data

Jul. 28, 2000 (JP) ..... 2000-229844
Mar. 23, 2001 (JP) ..... 2001-086340

(51) Int. Cl.[7] ..... G09G 3/36

(52) U.S. Cl. ..... 345/92; 345/98; 345/99; 345/100; 345/211; 345/96; 345/103; 349/56; 349/148; 349/141; 349/142; 349/143; 349/145

(58) Field of Search ..... 345/211, 87, 98, 345/99, 100, 92, 103, 96; 349/56, 148, 141, 145, 139, 140, 143, 54

(56) References Cited

U.S. PATENT DOCUMENTS 5,828,430 A * 10/1998 Nishida ..... 349/44

FOREIGN PATENT DOCUMENTS

JP 01213623 8/1989
JP 09-211421 8/1997
JP 10-253940 9/1998

OTHER PUBLICATIONS

Fujita, Kazuhisa, JP 10253940 A, Sep. 1998, Machine Translation.*

* cited by examiner

*Primary Examiner*—Henry N. Tran
*Assistant Examiner*—Peter Prizio
(74) *Attorney, Agent, or Firm*—David G. Conlin; William J. Daley, Jr.; Edwards & Angell, LLP

(57) ABSTRACT

On a termination side of each scanning line is provided a charging switching element and a discharging switching element in parallel with each other, the charging switching element having a gate electrode which is connected with one end of a scanning auxiliary line, the other end of which is connected to a scanning line of the same stage, the discharging switching element having a gate electrode which is connected with one end of a scanning auxiliary line, the other end of which is connected to a scanning line of the following stage. Further, the charging switching element has a source/drain electrode which is connected to a scanning line and a selected state scanning driving voltage power source, whereas the discharging switching element has a source/drain electrode which is connected to a scanning line and the non-selected state scanning driving voltage power source, thereby allowing an image display device of the present invention to suppress the dull waveform of a driving voltage at both rise and fall, and prevent erroneous writing without reducing effective writing time.

17 Claims, 18 Drawing Sheets

A–A

IMAGE DISPLAY DEVICE

FIELD OF THE INVENTION

The present invention relates to a display device capable of display such as liquid crystal display and EL (Electro-Luminescence) display, and in particular to a display device driven by an active matrix.

BACKGROUND OF THE INVENTION

FIGS. 7(*a*) and 7(*b*) show schematic cross sectional views respectively showing configurations and operation of a liquid crystal display device.

As shown in FIG. 7(*a*), the liquid crystal display device has an arrangement in which on one side of a glass substrate 1001 is formed an electrode 1002, on one side of a glass substrate 1011 is formed an electrode 1012, and further, on the electrodes 1002 and 1012 are respectively printed alignment materials on which alignment films 1003 and 1013 are respectively formed. After the formation of the alignment films 1003 and 1013, rubbing is applied to the alignment film 1003 in a direction parallel to a paper surface and the alignment film 1013 in a direction perpendicular to the paper surface. Further, a sandwich structure is formed by the two glass substrates 1001 and 1011 so that they sandwich the electrodes 1002 and 1012 in between. A TN (Twisted Nematic) liquid crystal material is filled between the glass substrates 1001 and 1011, thereby forming a liquid crystal layer 1021. Here, in the liquid crystal layer 1021, a liquid crystal molecule 1022 has a long axis, a direction of which is aligned with a rubbing direction in the vicinity of respective surfaces of the glass substrates 1001 and 1011, and the TN liquid crystal material is filled so that a long-axis direction is rotated by about 90° between the substrates. In addition, to outer surfaces of the glass substrates 1001 and 1011 are affixed polarizing plates 1004 and 1014 so that transmission axes thereof intersect each other.

Here, the liquid crystal display device as shown in FIG. 7(*a*) shows a state in which the liquid crystal layer 1021 is free from an application of a voltage (a state in which a driving voltage is OFF). For example, when light is incident from below the liquid crystal display device, only a polarizing component of the light which is parallel to a paper surface is transmitted through the polarizing plate 1004, then, a polarizing direction of the light is rotated by about 90° in the liquid crystal layer 1021, thereafter being emitted from the polarizing plate 1014, as the light having a polarization axis perpendicular to the paper surface. Thus, in the liquid crystal display device as shown in FIG. 7(*a*), bright display is attained by the transmission of light.

Meanwhile, supplying a voltage to the electrodes 1002 and 1012 so as to apply the voltage across the liquid crystal layer 1021 causes, as shown in FIG. 7(*b*), the liquid crystal molecules 1022 to rotate so that long axes are aligned in a direction of an electric field. Here, light which is incident from the polarizing plate 1004 and has a polarizing component perpendicular to a paper surface has a polarization axis which does not rotate in the liquid crystal layer 1021. Therefore, even when incident onto the polarizing plate 1014 having a polarization axis in a direction perpendicular to the paper surface, the light cannot be transmitted through the polarizing plate 1014, thereby attaining dark display in the liquid crystal display device shown in FIG. 7(*b*).

FIG. 8 is a plan view showing a schematic configuration of a simple matrix liquid crystal display device adopting the principles of configuration of FIG. 7.

The simple matrix liquid crystal display device has two glass substrates sandwiching a liquid crystal layer, on each of which are formed scanning lines 1031-1 to **1031-*n*, and signal lines 1041-1 to 1041-*m*. The scanning lines 1031-1 to 1031-*n* and the signal lines 1041-1 to 1041-*m* are formed as extra-fine transparent lines in stripes intersecting each other. In addition, the scanning lines 1031-1 to 1031-*n* and the signal lines 1041-1 to 1041-*m*** are respectively driven by a scanning electrode driving IC and a signal electrode driving IC. By controlling a voltage to be applied to pixels each of which is formed on a point of intersection of the lines, it is possible to control a state of alignment of liquid crystal molecules per pixel in the liquid crystal layer, thereby performing display.

Drawbacks to the simple matrix liquid crystal display device are as follows: (i) reduction in contrast of pixels on display, which is caused by an increase in the number of scanning lines, which causes an effective voltage to be applied to a liquid crystal at each point of intersection of the scanning lines to gradually decrease toward a tip, that is not suitable for a high-definition liquid crystal display device; and (ii) low response speed.

The problem of the simple matrix liquid crystal display device is solved in, for example, an active-matrix liquid crystal display device having a switching element in each pixel. FIG. 9 shows the configuration of a common conventional active-matrix liquid crystal display device. Further, FIGS. 10(*a*) and 10(*b*) show pixel arrangements in the active-matrix (reverse-staggered) liquid crystal display device.

The active-matrix liquid crystal display device as shown in FIG. 9 is an example in which a TFT (Thin Film Transistor) 1051 is adopted as a switching element. The active-matrix liquid crystal display device has two glass substrates sandwiching a liquid crystal layer, one of which has scanning lines 1061-1 to **1061-*n* and signal lines 1071-1 to 1071-*m* disposed thereon in a lattice state, where a pixel 1052 is connected, via the TFT 1051 being the switching element of a pixel, at a point of intersection of scanning and signal electrodes to be connected to the scanning lines 1061-1 to 1061-*n* and the signal lines 1071-1 to 1071-*m*, respectively. Further, the scanning lines 1061-1 to 1061-*n* and the signal lines 1071-1 to 1071-*m* are respectively connected with a scanning electrode driving IC 1062 and a signal electrode driving IC 1072**.

The active-matrix liquid crystal display device has an pixel arrangement, as shown in FIGS. 10(*a*) and 10(*b*), in which a TFT board 1081 having TFTs 1051, scanning lines 1061 and signal lines 1071 provided thereon, and a CF board 1091 having a counter electrode 1092 provided thereon are disposed with an interval, and a liquid crystal layer 1101 is sealed between a pixel electrode 1082 on the side of the TFT board 1081 and a counter electrode 1092 on the side of the CF board 1091.

On the TFT board 1081, on one side of the glass substrate 1083 is formed a polarizing plate 1084, and on the other side of the glass substrate 1083 are formed the scanning lines 1061 including the scanning electrode (gate electrode) 1063, an insulating film layer 1085, a semiconductor 1086, the signal lines 1071 and a pixel electrode 1082, and an alignment film 1087 successively.

On the other hand, on the CF board 1091, on one side of the glass substrate 1093 is formed a polarizing plate 1094, and on the other side of the glass substrate 1093 are formed a color filter layer 1095 in which color plates R/G/B/Bk are stacked, a counter electrode 1092, and an alignment film 1096 successively.

Next, the following will explain operation of the active-matrix liquid crystal display device with reference to FIG. 9.

First, when an ON voltage is outputted with respect to the scanning line at a first line 1061-1 from the scanning electrode driving IC 1062 (here, an OFF voltage is outputted to the other scanning lines), all the TFTs 1051 become ON, the TFTs 1051 being respectively connected to the scanning electrodes at a first line 1063 via the scanning lines 1061-1. Then, a data signal corresponding to a scanning line at a first line is offered from the signal electrode driving IC 1072 to each of the signal lines 1071. Here, since a circuit from a signal electrode of each of the signal lines 1071 to the pixel electrode 1082 via the TFTs 1051 is in a conducting state, a signal voltage (data signal) is applied to all pixel electrodes 1082 connected to the scanning line at the first line 1061-1, and data is written into pixels 1052 corresponding to the pixel electrodes 1082. Thereafter, the output of the scanning electrode driving IC 1062 with respect to the scanning line at the first line 1061-1 becomes an OFF voltage. This causes the TFTs 1051 connected to the scanning line 1061-1 to become OFF, thereby ceasing conduction between the signal electrode and the pixel electrodes 1082 of each of the signal lines 1071, and terminating writing with respect to the pixels 1052.

When a scanning output to the scanning line at the first line 1061-1 becomes an OFF voltage, an ON voltage is concurrently outputted continuously from the scanning electrode driving IC 1062 to a scanning line at a second line 1061-2. The repetition of this operation until the last line terminates driving for one screen.

In the case of the common driving of the active-matrix liquid crystal display device as above, resistance and parasitic capacitance of the scanning electrode 1063 affect a scanning voltage waveform as shown in FIG. 11 to change from a rectangular waveform indicated by the solid line on the side of an input end (the side closer to the scanning electrode driving IC) of each of the scanning lines 1061 into a dull waveform indicated by the broken line, as it approaches to a termination end.

Such a change of the scanning voltage waveform into a dull waveform raises a problem such that it causes deviation in the ON/OFF timing of the TFT 1051 at the both input and termination ends of the scanning lines, and an application of a signal voltage at the following stage earlier than the switch of the TFT 1051 to an OFF state at the termination end causes a signal of the following stage to be written into a pixel, thereby occurring erroneous writing.

Against this problem, conventionally adopted is a method for reducing wiring resistance by enlarging the width of a line, increasing the film thickness of a line, changing the material of a line into a low-specific-resistivity wiring material, and the like. However, this method has a problem such that enlarging the width of a line increases the ratio of the area of a wiring portion within a pixel, thereby reducing the number of apertures through which light is transmitted.

Further, another method is to prevent erroneous writing by causing the ON timing of a signal voltage to deviate from the ON timing of a scanning voltage and thereby obtain sufficient offset time so as to prevent variation in a writing signal even when the OFF timing of the scanning voltage is delayed.

With this method, as in the case of a signal voltage waveform shown in FIG. 11, for example, with respect to the scanning line at a line k, offset time is set between the ON timing of a scanning voltage and the ON timing of a signal voltage. Therefore, even when a deviation occurs in a period of time from a switch of a scanning voltage with respect to the line k to an OFF state to a change in the TFT 1051 which is connected to the termination end of the line k into a state of non-conduction, the offset time thus set before a line (k+1) at the following stage starts writing prevents writing of line data (k+1) with respect to a pixel 1052 pertaining to the line k, thereby preventing erroneous writing.

Furthermore, a method for realizing easy writing by inputting a scanning driving voltage to each scanning line through both ends has already gone into the actual use. This prior art, as shown in FIG. 12, drives scanning lines 1111 by connecting thereto the output of two scanning electrode driving ICs 1112 and 1113 from the both left and right sides, thereby suppressing emergence of a dull scanning voltage waveform at the termination end of a scanning line, which was generated during one-side driving.

However, when using the two scanning electrode driving ICs 1112 and 1113 to drive a single scanning line as above, what is concerned is that a deviation in output between the scanning electrode driving ICs 1112 and 1113 causes inconsistencies in input voltages on the left and right, which generates a through current between the ICs.

A technique to solve the problem of the foregoing prior art is disclosed in Japanese Unexamined Patent Publication No. 213623/1989 (Tokukaihei 1-213623 published on Aug. 28, 1989).

According to the technique as disclosed in the publication 1-213623, as shown in FIG. 13, it is arranged that the output of the scanning electrode driving IC 1122 is divided into two, and one of which is directly connected to one end of each of the scanning lines 1121 and the other, as a line, to the other end of each of the scanning lines 1121 first via upper and lower ends of a display panel 1131 then via a connection board 1132. Accordingly, the single output of the single IC is applied to each of the scanning lines 1121 through the both ends, thereby solving the problem resulted from a deviation in output between the scanning electrode driving ICs.

Meanwhile, a liquid crystal display device as disclosed in Japanese Unexamined Patent Publication No. 253940/1998 (Tokukaihei 10-253940 published on Sep. 25, 1998) includes, as shown in FIG. 14, a discharging switching elements 1142 provided at the termination end of each of scanning lines 1141. As to each of the discharging switching elements 1142, a gate electrode thereof is connected with the scanning line 1141 of the following stage, and a source/drain electrode thereof is connected with the scanning line 1141 of the same stage and a scanning driving voltage power source 1151 which supplies a scanning driving voltage of a non-selected period (hereinafter referred to as "non-selected state scanning driving voltage power source").

In the liquid crystal display device of the foregoing arrangement, when each of the scanning lines 1141 are switched from a selected state to a non-selected state, an ON signal from the scanning line 1141 of the following state that is newly switched to a selected state is applied to the discharging switching element 1142. Accordingly, when the discharging switching element 1142 is turned ON, with respect to the non-selected scanning line 1141, a non-selected state scanning driving voltage is applied from the termination end thereof, thereby suppressing the dull fall of a scanning driving voltage waveform when the scanning line 1141 is non-selected.

However, the above conventional arrangements have the following problems.

First, as shown in FIG. 11, a method for staggering the respective ON timings of a scanning voltage and a signal voltage has a problem as follows: since offset is allowed in a signal voltage input, actual time for writing (effective writing time) is more reduced than scanning time per line. Therefore, the writing of a TFT 1051 at the termination end is terminated in an OFF state, i.e., the TFT 1051 fails to be charged to a writing voltage within the writing time and stays low in charge when the writing thereof is terminated. Further, a display device which has high resolution and short writing time has a problem such that erroneous writing and deficient writing cannot simultaneously be prevented due to the lack of sufficient offset time, thereby impairing display quality.

Further, in the method of FIG. 12, twice the number of the scanning electrode diving ICs are required compared to the case of performing one-side driving. Further, in the method according to the publication 1-213623, the number of scanning lines and connection boards for the routing of a scanning signal increase. Therefore, in either case, there arises a problem of increase in costs due to increase in the number of components and in work hours for assembly.

Further, in the liquid crystal display device disclosed in the publication 10-253940, erroneous writing can be prevented by suppressing the dull fall of the scanning driving voltage waveform. However, since suppressing a dull rise is not taken into consideration, the rise of the switching element of a pixel delays when turned ON. Accordingly, effective writing time is reduced, thereby being unable to prevent the shortage of charges in a display pixel.

Further, in the liquid crystal display device disclosed in the publication 10-253940, a gate electrode itself of the discharging switching element is connected to the termination end of the scanning line of the following stage. This delays the rise of the gate electrode of the switching element and prevents the prompt action of a voltage applied from the non-selected state scanning driving voltage power source. Thus, a sufficient improvement cannot be expected.

Note that, the foregoing problems are not unique to a liquid crystal display device and may also emerge in other active-matrix image display devices adopting a TFT as a switching element such as an EL display device and the like.

SUMMARY OF THE INVENTION

It is an object of the present invention to provide an image display device capable of preventing erroneous writing while (i) suppressing an increase in costs, (ii) suppressing a driving voltage waveform to grow dull at both rise and fall, and (iii) preventing reduction in effective writing time.

An image display device according to the present invention is an active-matrix display device which has a plurality of scanning lines and a plurality of signal lines respectively disposed in directions to mutually intersect, and a plurality of display pixels disposed in a matrix, each of which is connected via a pixel switching element to each intersecting point where the lines intersect. In order to attain the foregoing object, the image display device includes scanning auxiliary lines which are respectively provided to the scanning lines, the scanning auxiliary lines allowing smaller signal delay than the scanning lines, branching off from one side of the scanning lines to which signals are applied (the side which is connected to a scanning electrode driving circuit) and being connected to the scanning lines, and the image display device has at least one arrangement selected from the group consisting:

(i) an arrangement, wherein:

charging switching elements (TFTs, for example), each of which is connected to an edge portion of each of the scanning lines on a side opposite to the side to which the signals are applied, has a control terminal to which a scanning auxiliary line of the same stage as that of the connected scanning line is connected, and is controlled by a scanning signal of the same stage to be turned ON/OFF, and a selected state scanning driving voltage power source which supplies a selected scanning driving voltage to a scanning line which is connected to a termination end of the scanning lines (a side opposite to a side to which a scanning electrode driving circuit is connected) via a charging switching element in an ON state, from the termination end; and (ii) an arrangement, wherein:

discharging switching elements (TFTs, for example), each of which is connected to an edge portion of each of the scanning lines on a side opposite to the side to which signals are applied, has a control terminal to which a scanning auxiliary line of the following stage of the connected scanning line is connected, and is controlled by a scanning signal of the following stage whether to be turned ON/OFF, and a non-selected state scanning driving voltage power source which supplies a non-selected state scanning driving voltage to a scanning line which is connected to the termination end of the scanning lines via a discharging switching element in an ON state, from the termination end.

With this arrangement, each of the scanning lines is connected, at its termination end, to the selected state scanning driving voltage power source or the non-selected state scanning driving voltage power source via the charging or discharging switching element.

Further, in the arrangement having the charging switching element and the selected state scanning driving voltage power source, when one of the scanning lines is switched to a selected state, an ON scanning signal which is applied to the scanning line turns the charging switching element ON via the scanning auxiliary line. Accordingly, the selected state scanning driving voltage power source applies a selected state scanning driving voltage to the selected scanning line from its termination end. Here, since the scanning auxiliary line allows only small signal delay, the charging switching element promptly rises, and the selected state scanning driving voltage can also be applied abruptly to a pixel switching element at the termination end of the scanning lines in particular, thereby improving the dull waveform of the scanning driving voltage at rise.

Further, in the arrangement having the discharging switching element and the non-selected state scanning driving voltage power source, when one of the scanning lines is switched from a selected state to a non-selected state, a scanning line of the following stage is switched to the selected state. Therefore, one of the discharging switching elements having a control terminal connected to a scanning auxiliary line of the following stage promptly rises, and a non-selected state scanning driving voltage can be applied abruptly to a pixel switching element at the termination end of the scanning lines, thereby improving the dull waveform of the scanning driving voltage at fall.

An image display device according to the present invention is an active-matrix image display device having a plurality of scanning lines and a plurality of signal lines respectively disposed in directions to intersect with the other, and a plurality of display pixels disposed in a matrix, each of which is connected via a pixel switching element to each intersecting point where the lines intersect. In order to attain the foregoing object, the image display device includes: branch scanning lines which allow smaller signal delay than the scanning lines, branch off from one side of the scanning lines to which signals are applied, and are connected to the scanning lines from which they branched off at an edge portion on a side opposite to the side to which the signals are applied, the branch scanning lines being disposed adjacent to the scanning lines to which they are connected on a board on which the scanning lines are formed.

With this arrangement, the branch scanning lines allow smaller signal delay than the scanning lines, branch off from one side of the scanning lines to which signals are applied, and are connected to the scanning lines from which they branched off on an edge portion on the side opposite to the side to which the signals are applied, thereby making it possible to apply a scanning signal outputted from a scanning electrode driving IC from a termination end of the scanning lines without causing signal delay.

Accordingly, it is possible to supply a scanning signal abruptly to a pixel switching element at the termination end of the scanning signals in particular, thereby improving the dull waveform of a scanning driving voltage at both rise and fall.

Further, the branch scanning lines are disposed adjacent to the scanning lines to which they are connected on a board on which the scanning lines are formed. Therefore, even when the image display device has high resolution and the large number of the scanning lines, the branch scanning lines can be readily provided without causing an increase in the number of components such as a connection board, unlike an arrangement in which the branch scanning lines are connected to the termination end of the scanning lines, first via upper and lower ends of the board, then via the connection board.

Additional objects, features, and strengths of the present invention will be made clear by the description below. Further, the advantages of the present invention will be evident from the following explanation in reference to the drawings.

BRIEF DESCRIPTION THE DRAWINGS

Figure 3A:
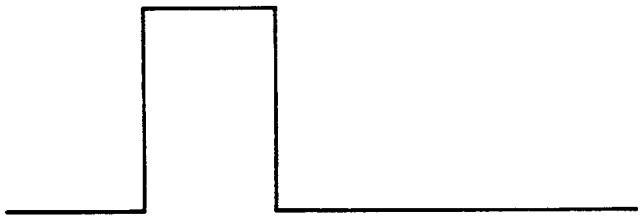
Figure 3B:
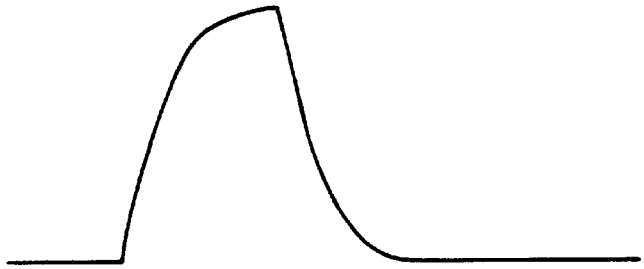
Figure 3C:
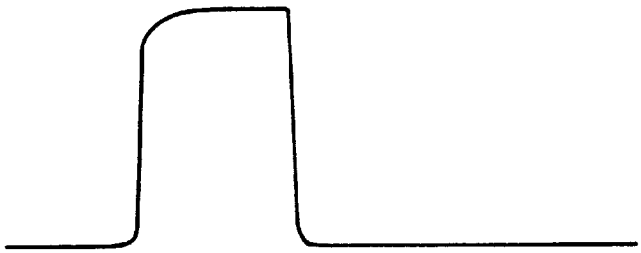

FIGS. 3(*a*) to 3(*c*) are explanatory views showing simulation waveforms of a voltage for comparing waveforms of a scanning driving voltage, of which FIG. 3(*a*) shows a voltage waveform at a connecting end of a scanning electrode driving IC, FIG. 3(*b*) shows a voltage waveform at the termination end of scanning wiring in a conventional example, and FIG. 3(*c*) shows a voltage waveform at the termination end of scanning wiring in one embodiment of the present invention.

Figure 4:
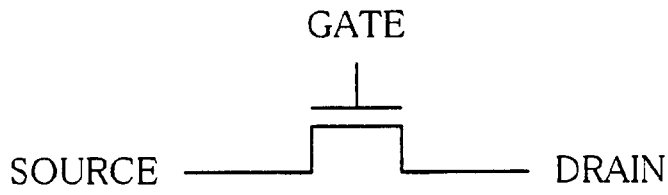
Figure 4:
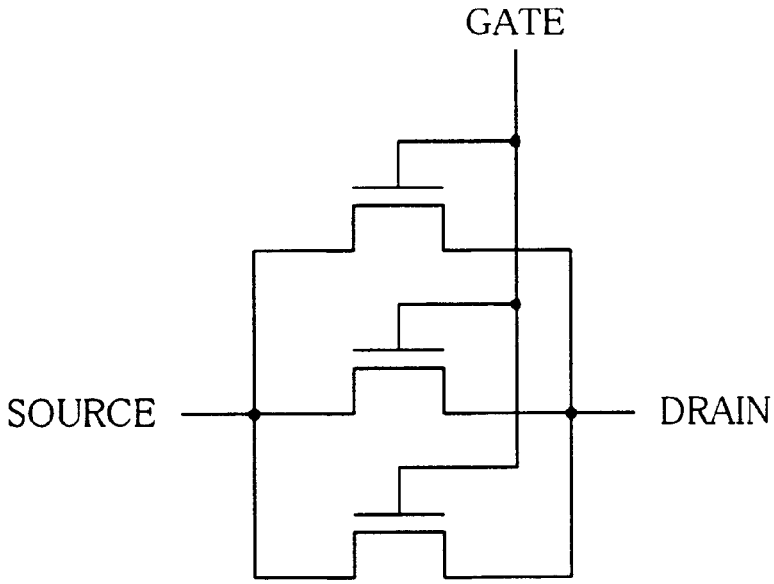

FIG. 4(*a*) is an explanatory view in the case where the liquid crystal display device includes a charging TFT or discharging TFT which is made up of a single TFT, and FIG. 4(*b*) is an explanatory view in the case where the liquid crystal display device includes a charging TFT or discharging TFT which is made up of a plurality of TFTs disposed in parallel with one another.

Figure 1:
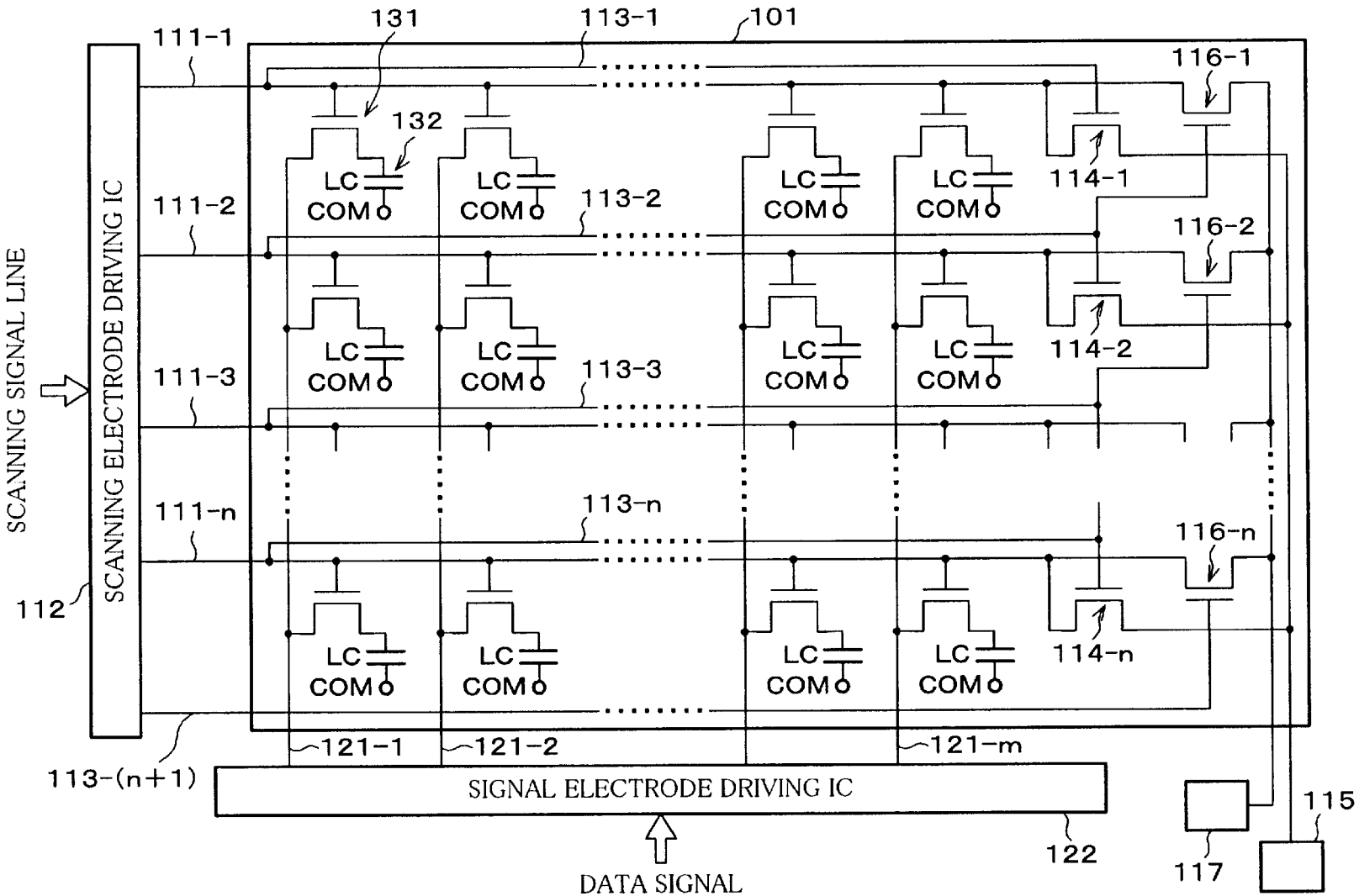
FIG. 1 is a diagram showing one embodiment of the present invention and is a circuit diagram showing a circuit configuration of a liquid crystal display device.
Figure 5:
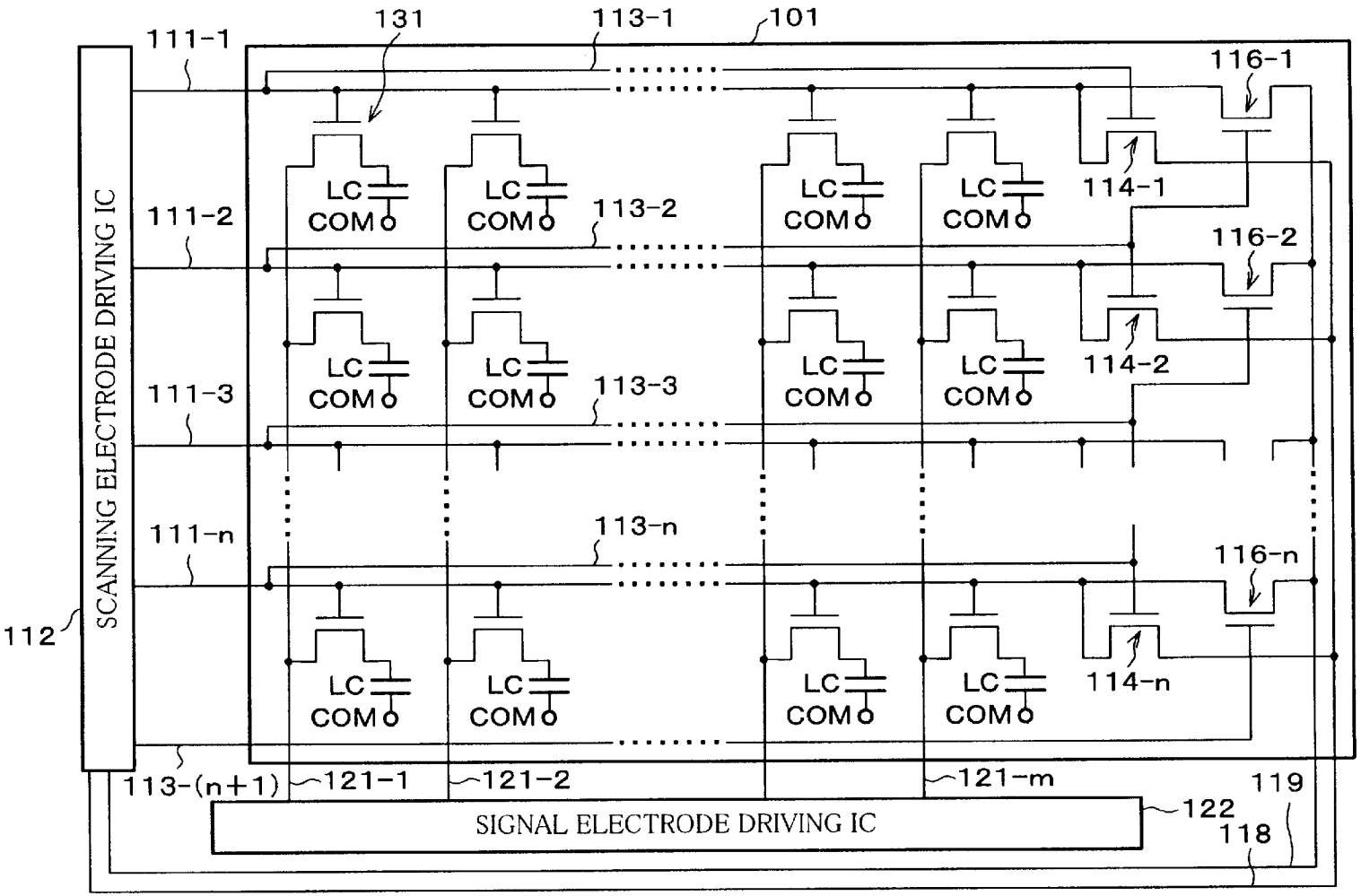

FIG. 5 is a diagram showing a modification example of the present invention and is a circuit diagram showing a circuit configuration of a liquid crystal display device, a configuration of which is different from that of FIG. 1.

Figure 6:
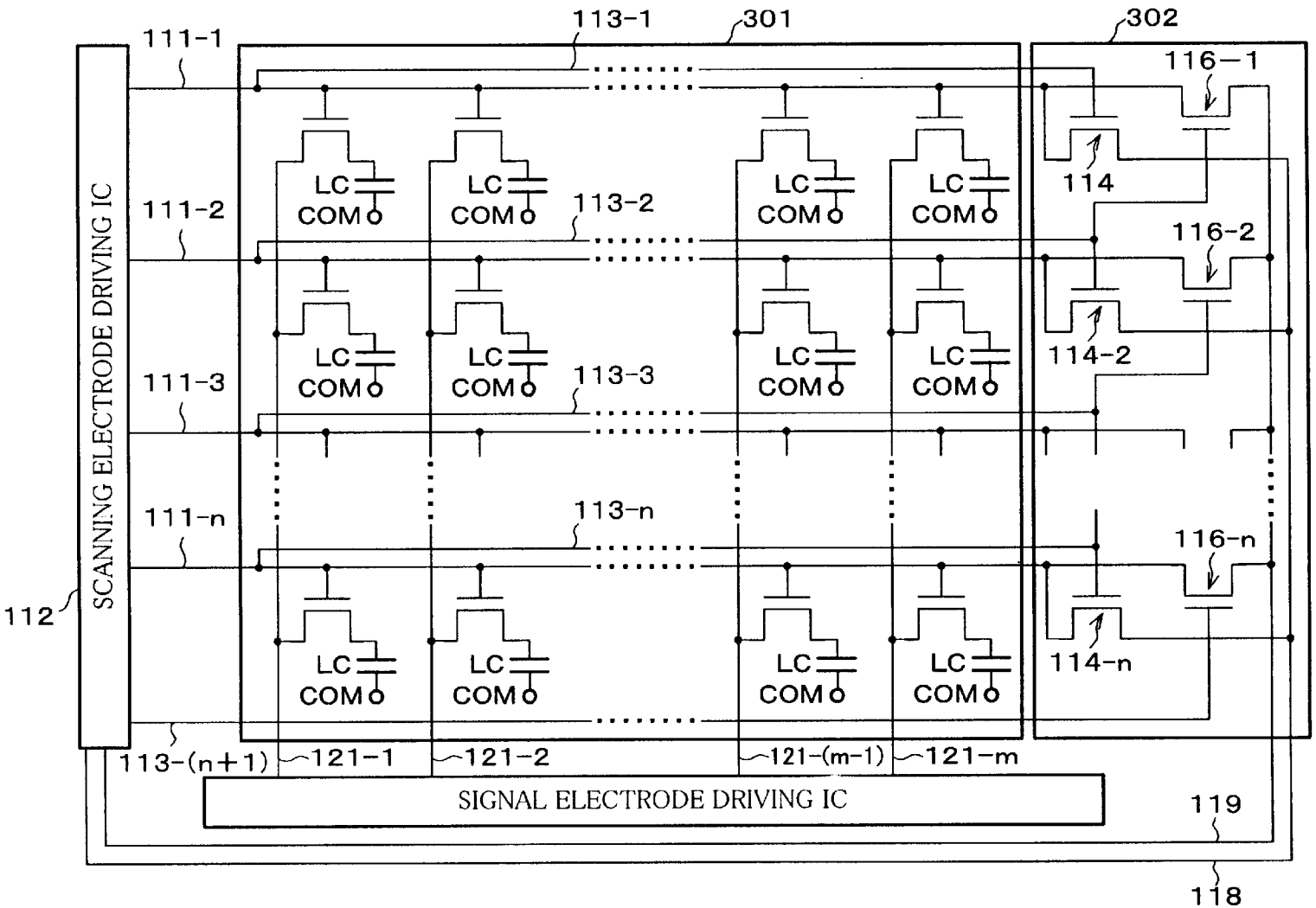

FIG. 6 is a diagram showing a modification example of the present invention and is a circuit diagram showing a circuit configuration of a liquid crystal display device, a configuration of which is different from those of FIGS. 1 and 5.

Figure 7:
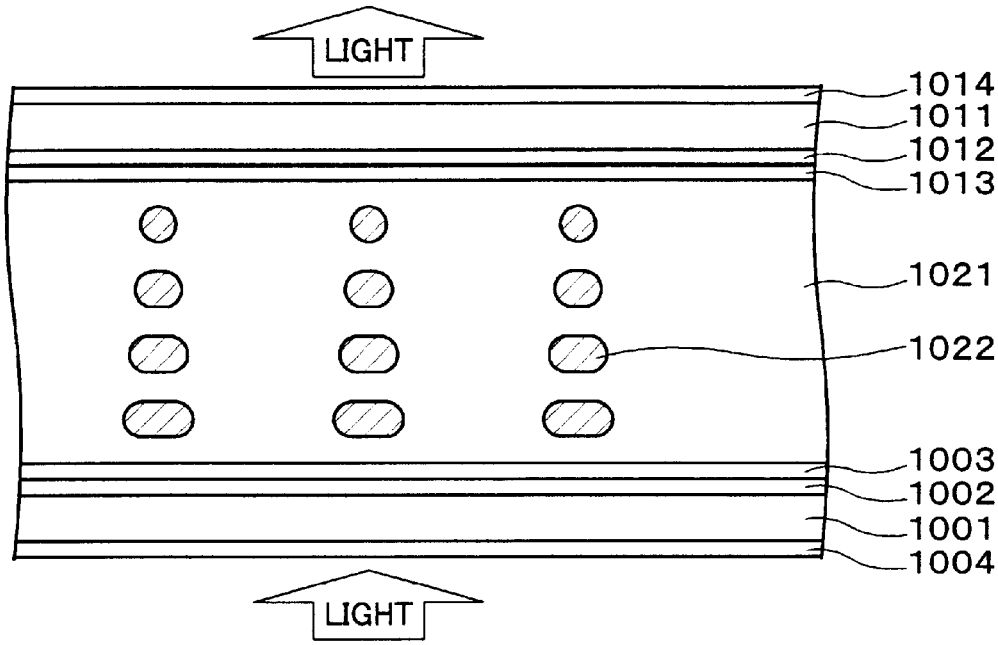
Figure 7:
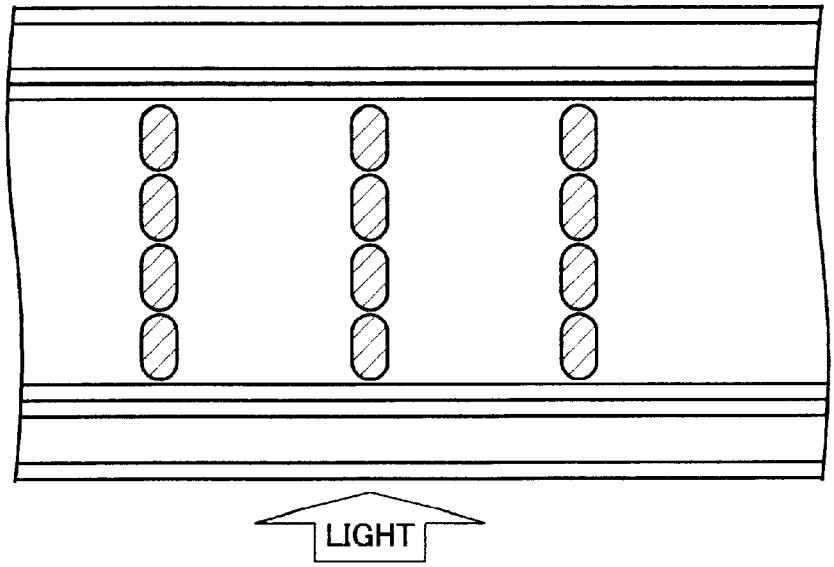

FIGS. 7(*a*) and 7(*b*) are schematic cross sectional views respectively showing concise configurations and operation of a liquid crystal display device, of which FIG. 7(*a*) shows a state in which a driving voltage is OFF, and FIG. 7(*b*) shows a state in which the driving voltage is ON.

Figure 8:
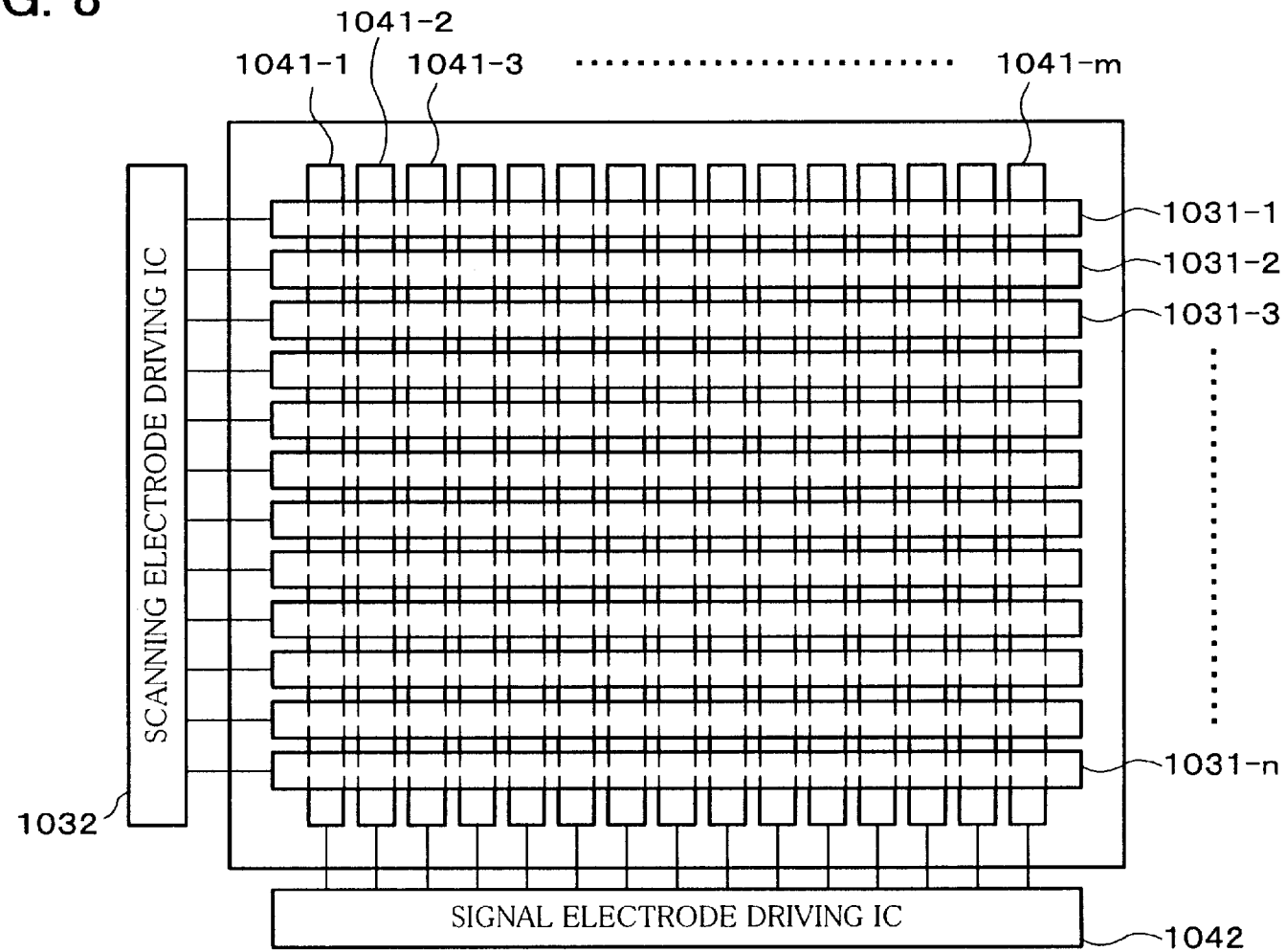

FIG. 8 is a plan view showing a schematic configuration of a simple matrix liquid crystal display device based on the principles of the configurations of FIGS. 7(*a*) and 7(*b*).

Figure 9:
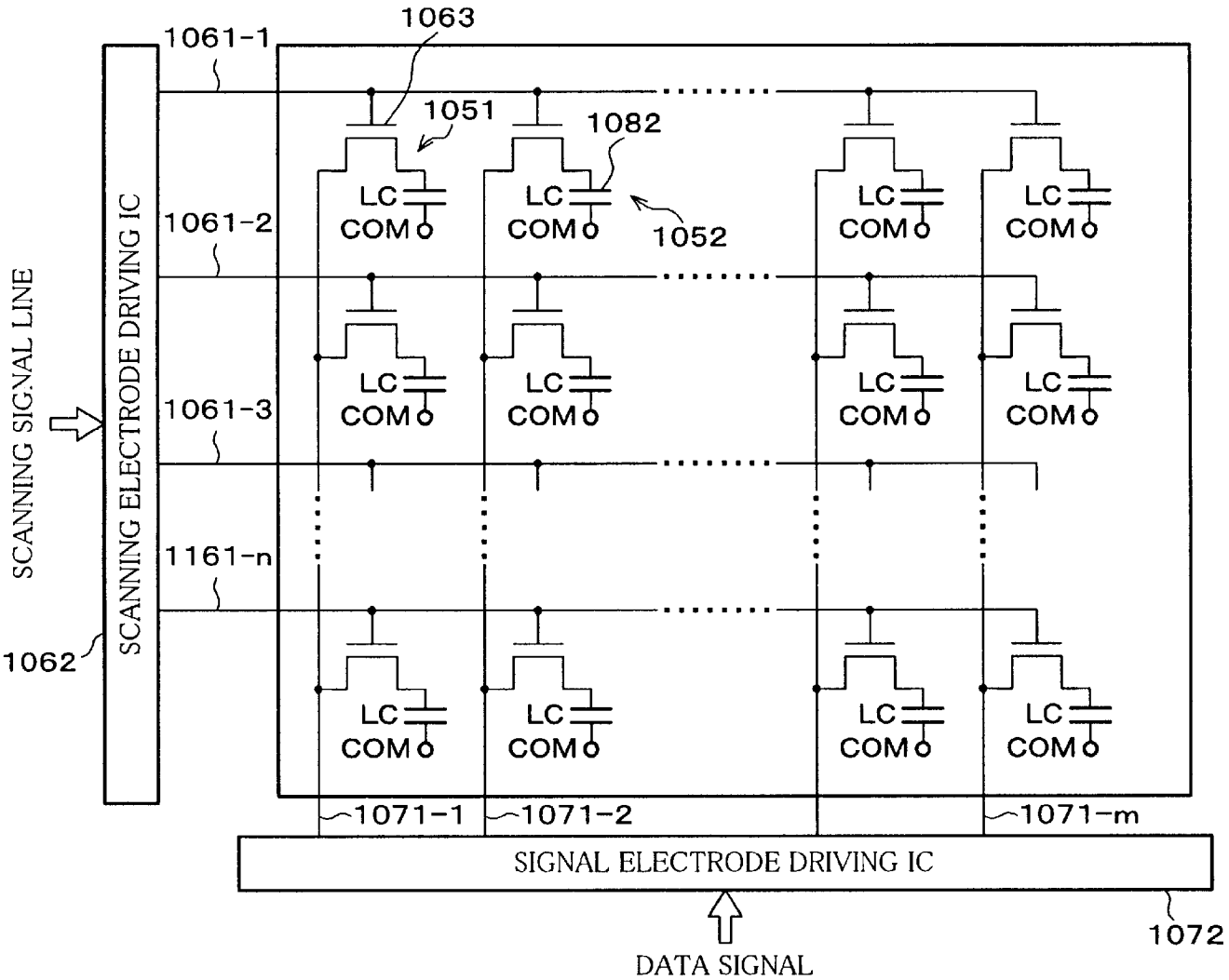

FIG. 9 is a circuit diagram showing a configuration of a common active-matrix liquid crystal display device according to prior art.

Figure 10:
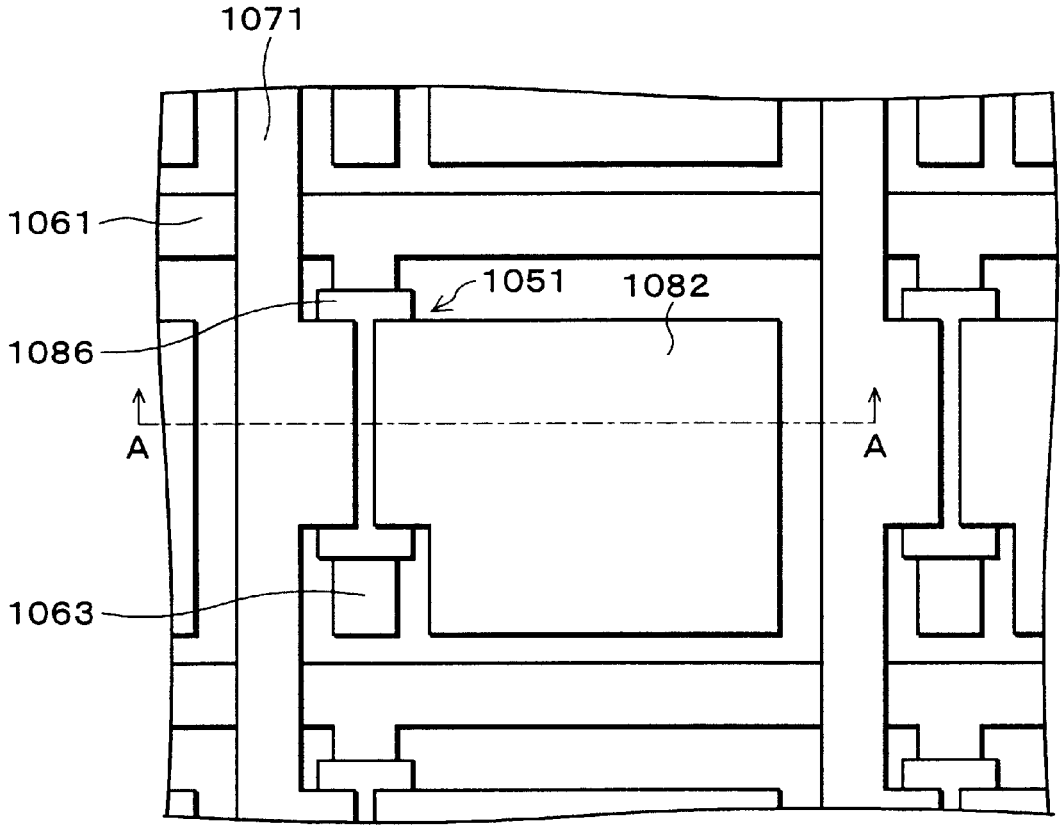
Figure 10:
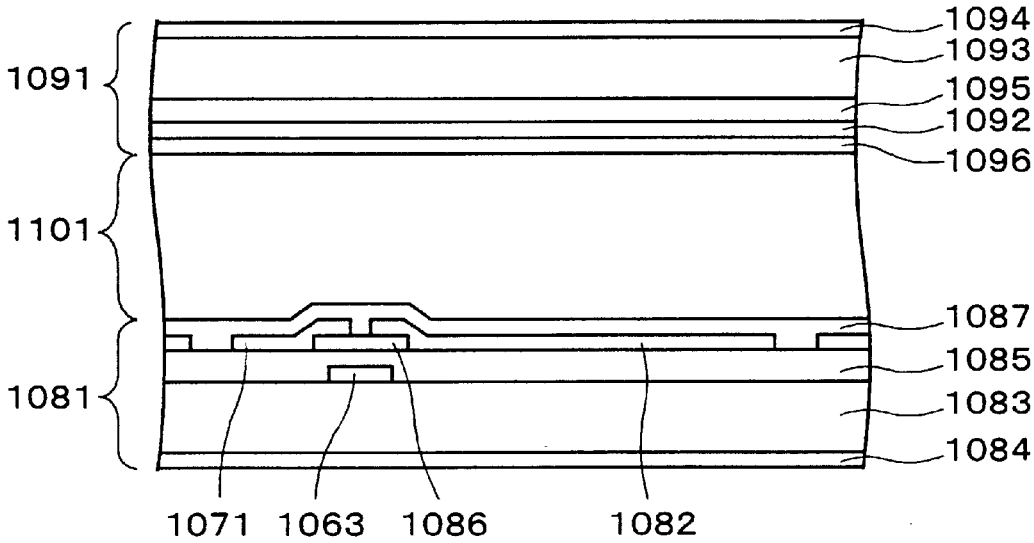

FIGS. 10(*a*) and 10(*b*) are diagrams showing pixel arrangements of the active-matrix (reverse-staggered) liquid crystal display device shown in FIG. 9, of which FIG. 10(*a*) is a plan view, and FIG. 10(*b*) is a cross sectional view of FIG. 10(*a*), taken along the line A—A.

Figure 11:
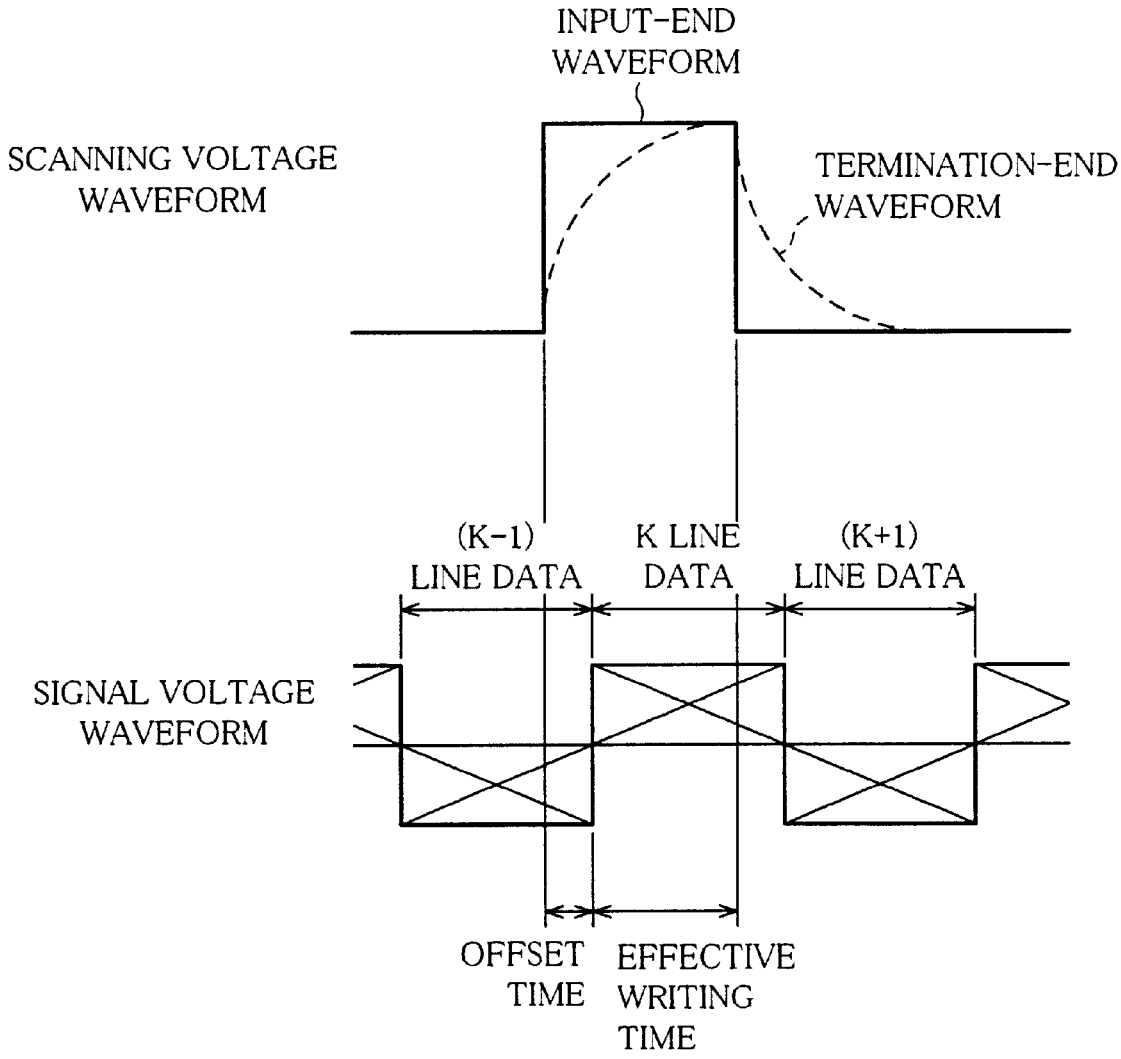

FIG. 11 is a timing chart showing a relation between a scanning voltage and a signal voltage when applied at different timings, in a conventional liquid crystal display device.

Figure 12:
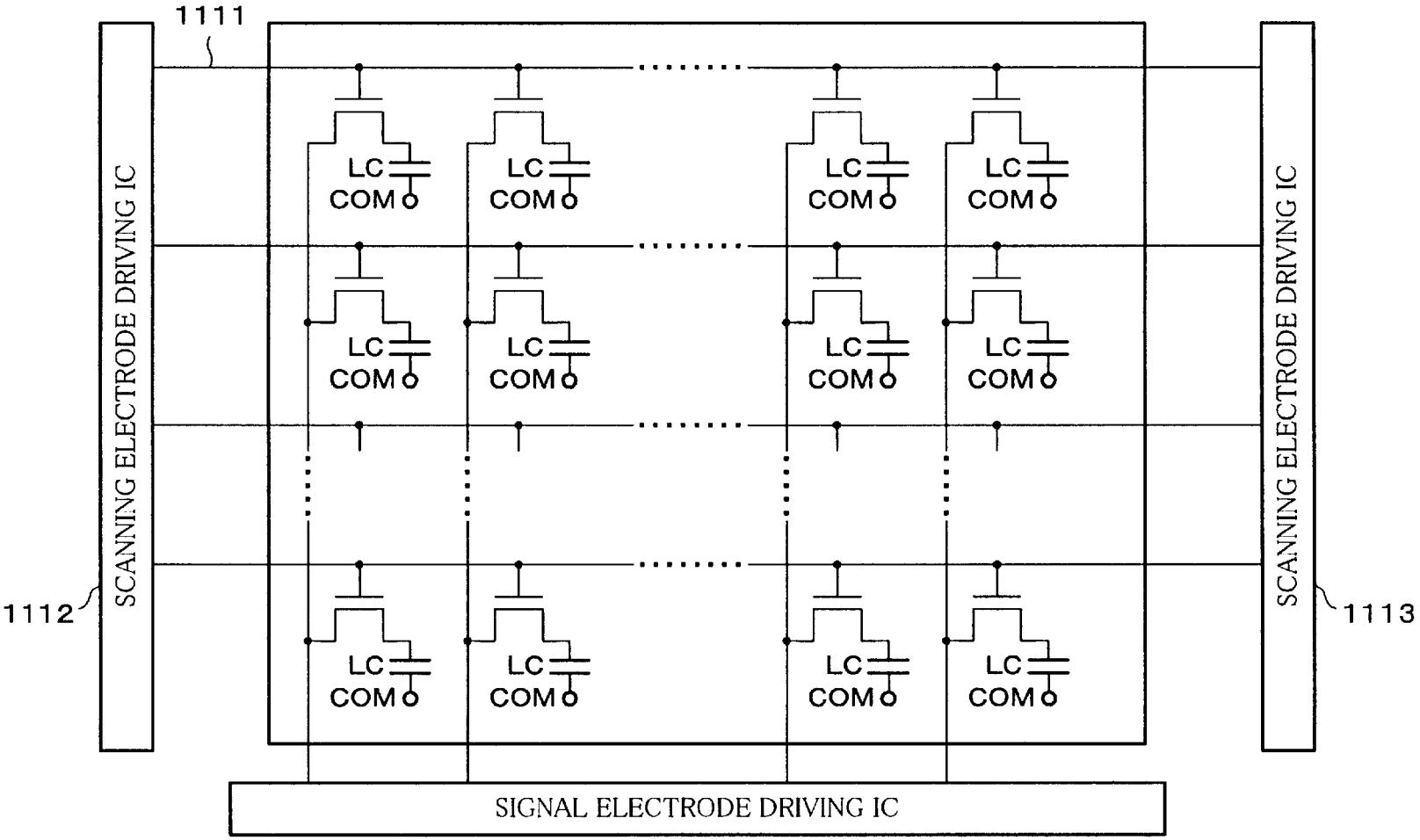

FIG. 12 is a circuit diagram showing one example of a conventional liquid crystal display device.

Figure 13:
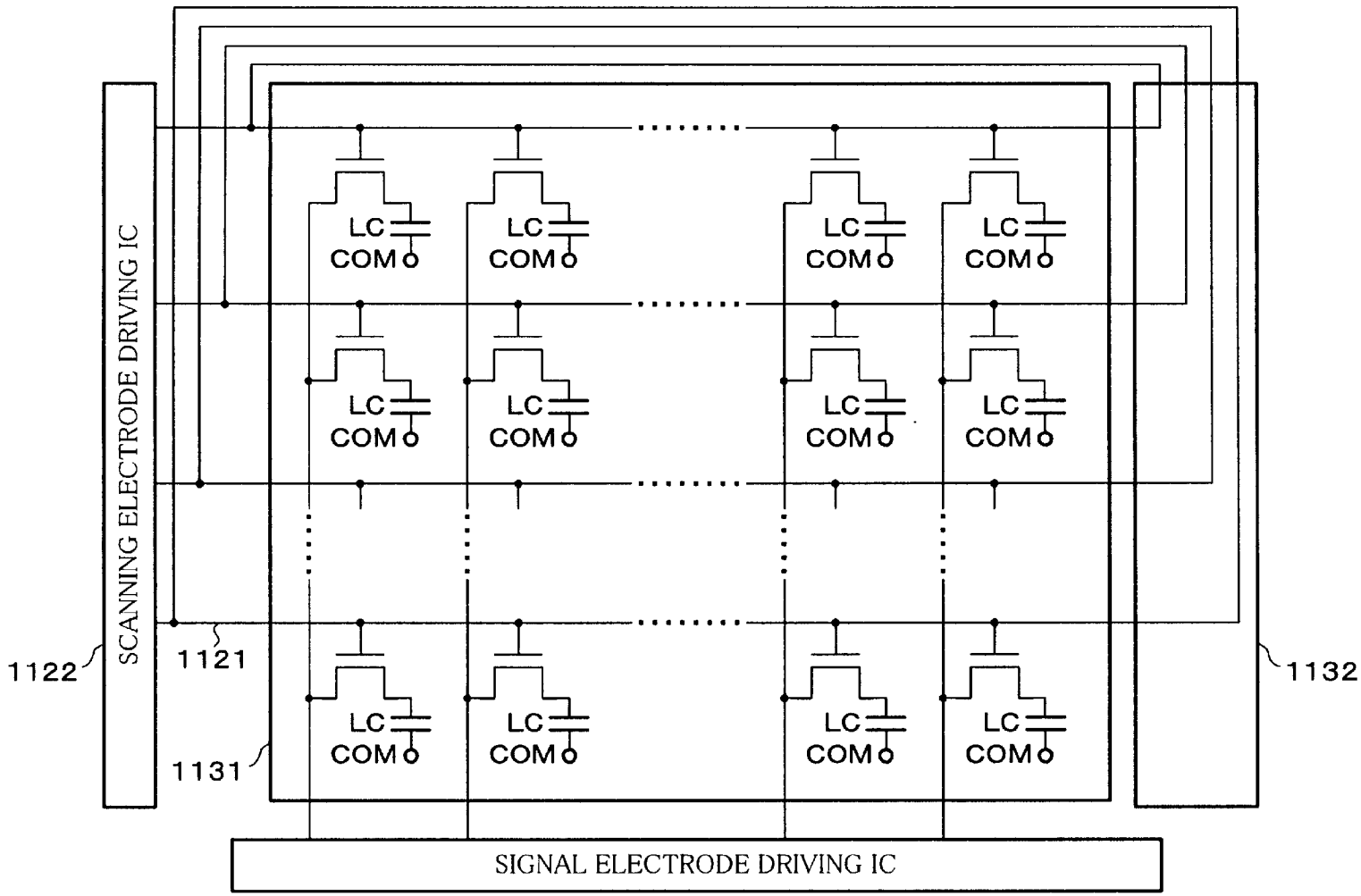

FIG. 13 is a circuit diagram showing one example of a conventional liquid crystal display device.

Figure 14:
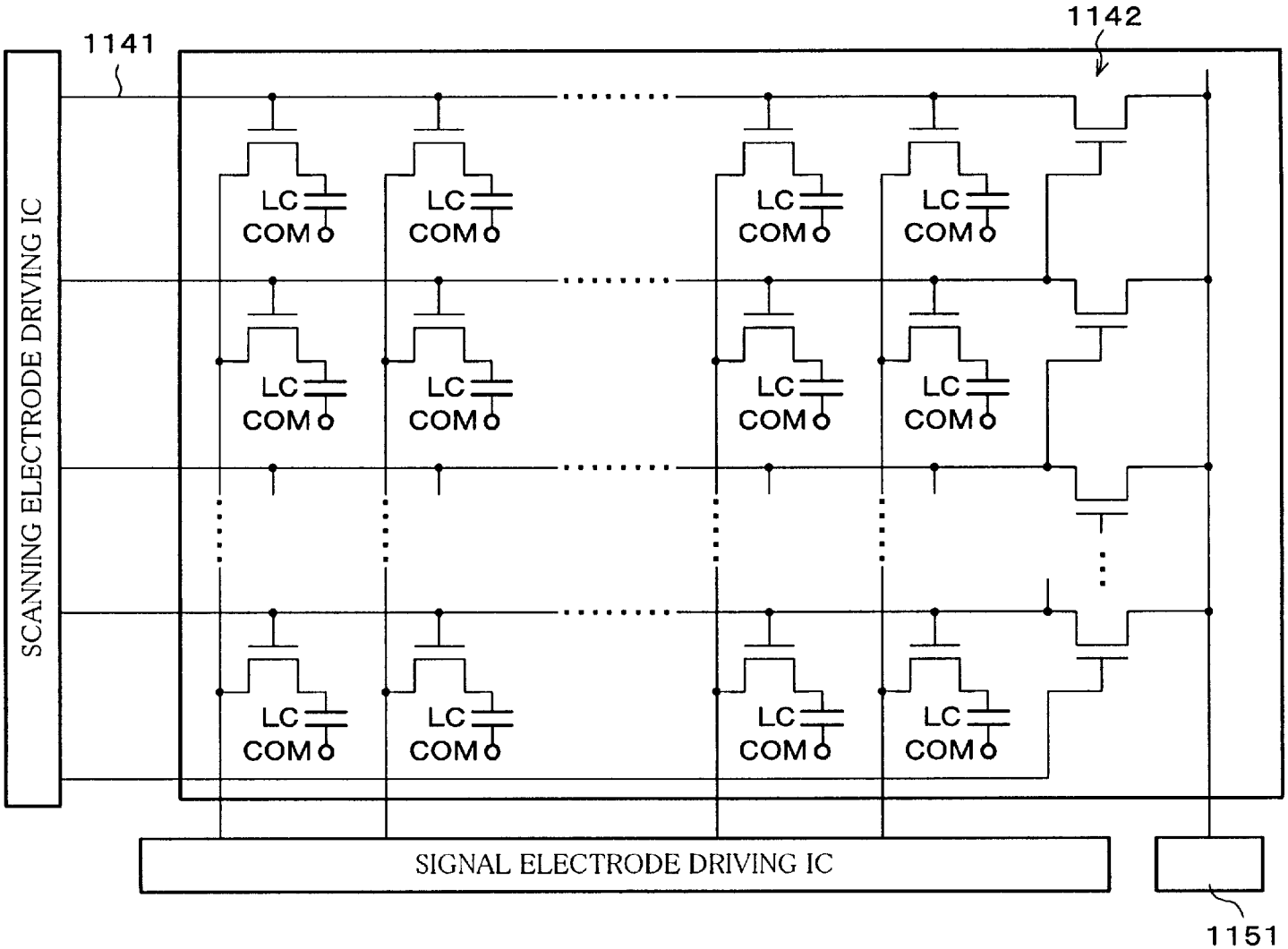

FIG. 14 is a circuit diagram showing one example of a conventional liquid crystal display device.

Figure 15:
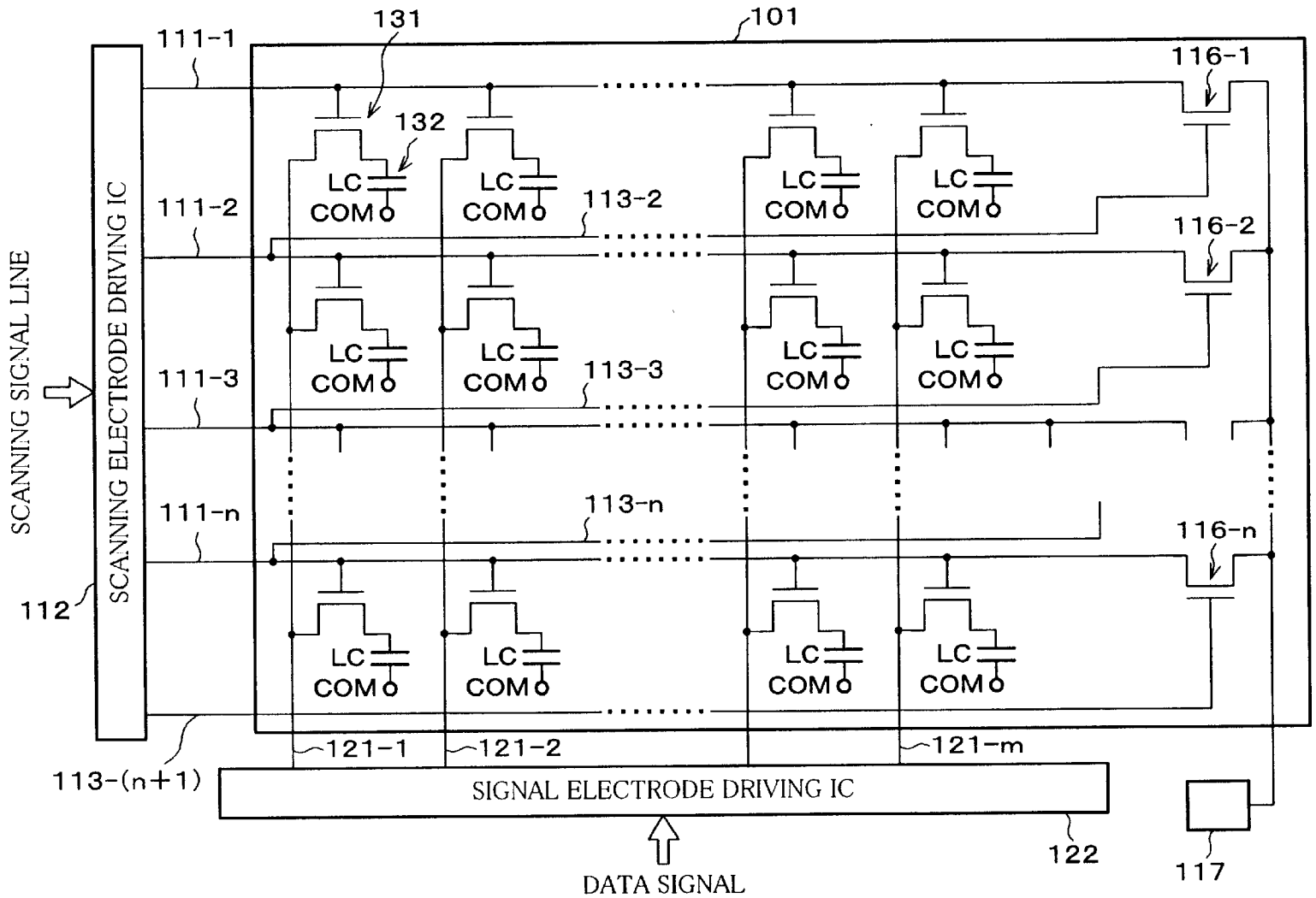

FIG. 15 is a diagram showing a modification example of the present invention and is a circuit diagram showing a circuit configuration of a liquid crystal display device, a configuration of which is different from that of FIG. 1.

Figure 16:
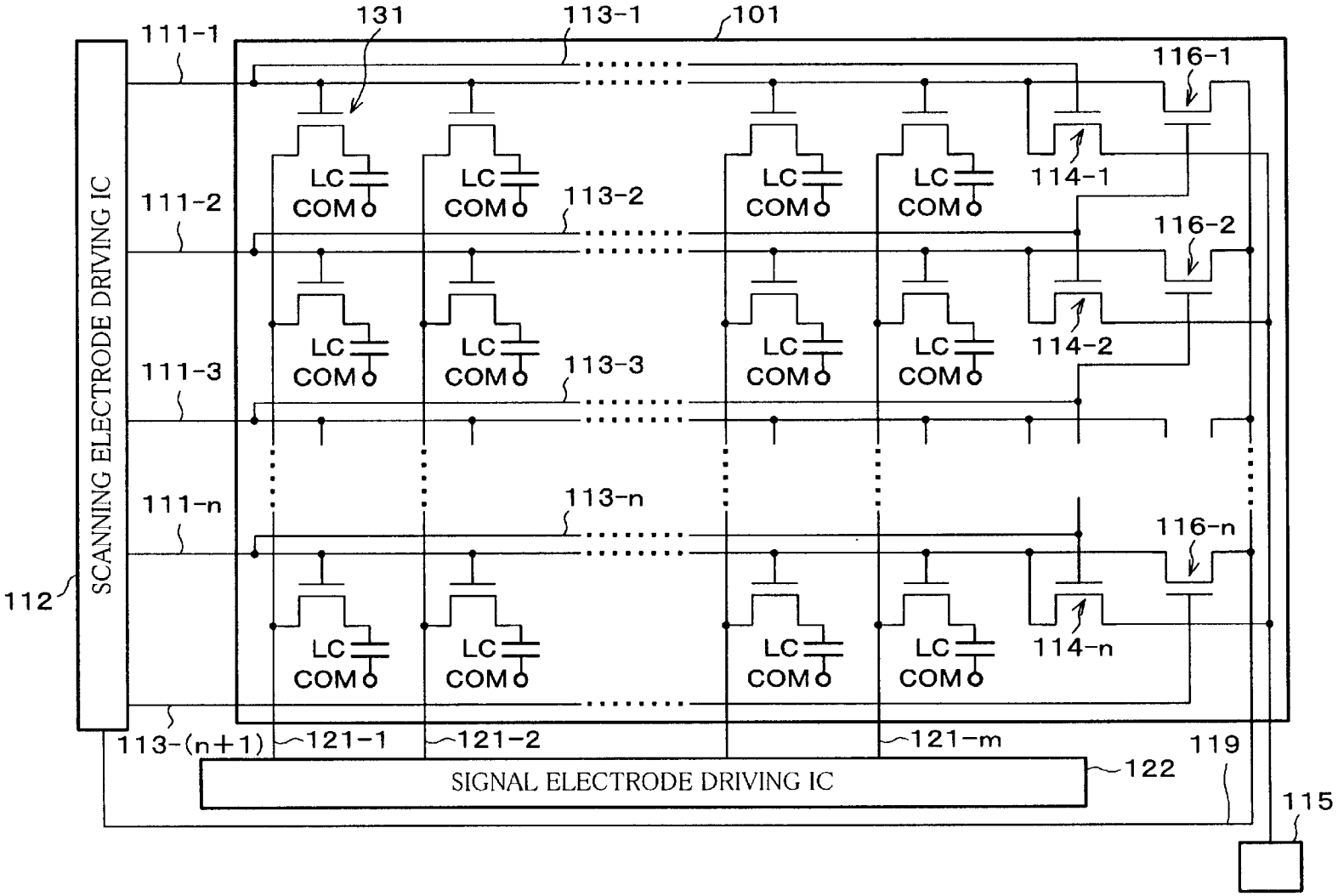

FIG. 16 is a diagram showing a modification example of the present invention and is a circuit diagram showing a circuit configuration of a liquid crystal display device, a configuration of which is different from that of FIG. 1.

Figure 17:
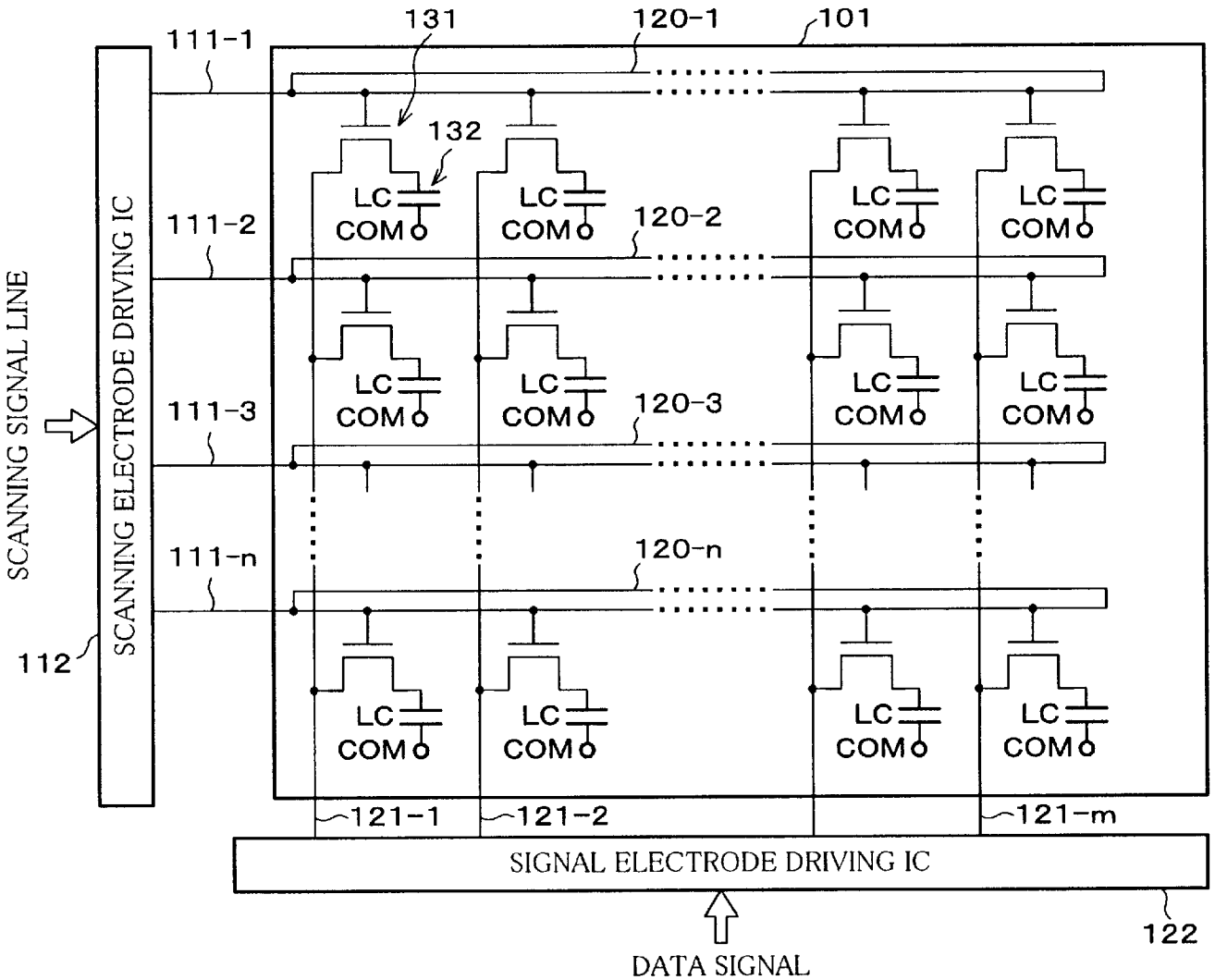

FIG. 17 is a diagram showing a modification example of the present invention and is a circuit diagram showing a circuit configuration of a liquid crystal display device, a configuration of which is different from that of FIG. 1.

Figure 18:
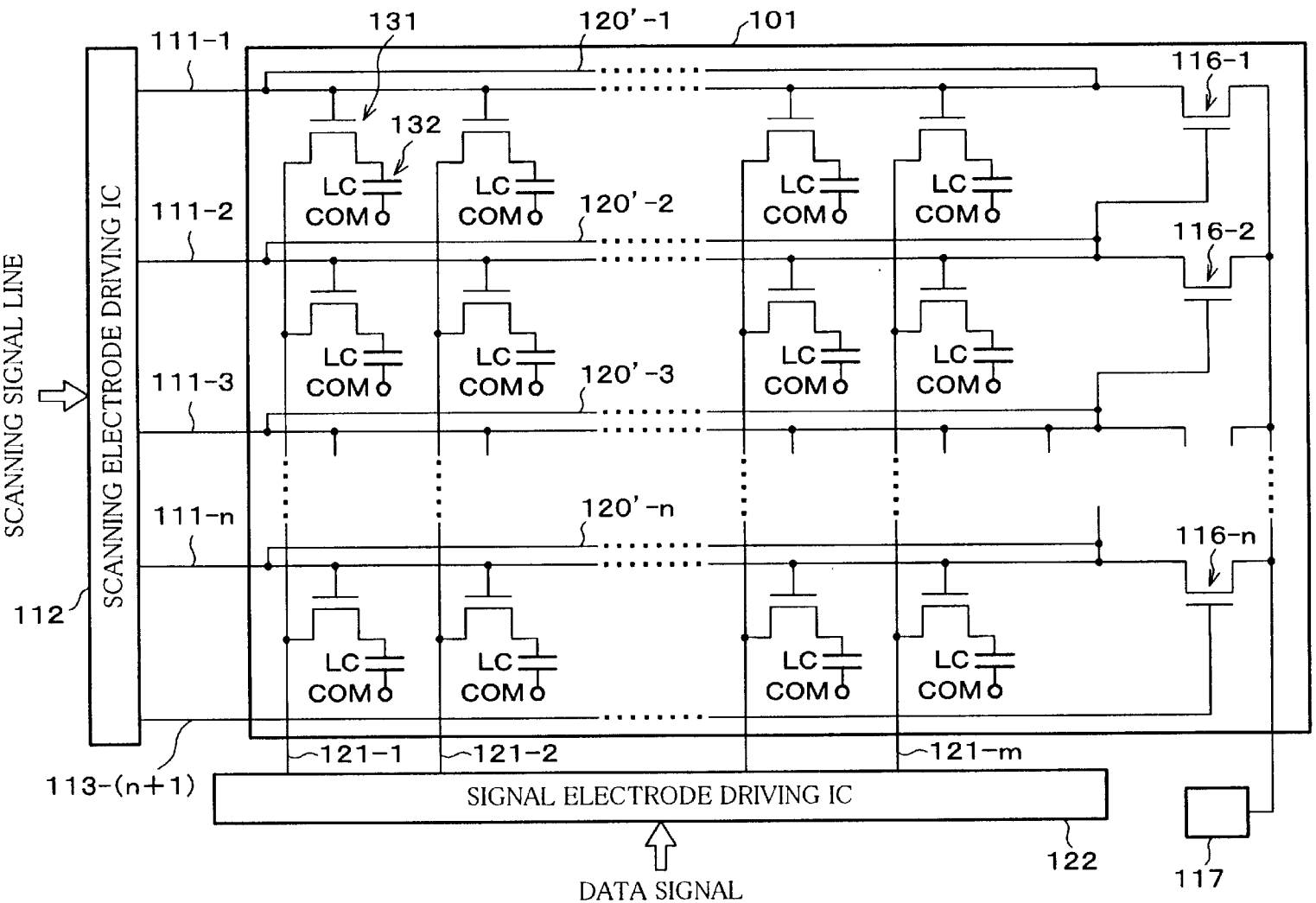

FIG. 18 is a diagram showing a modification example of the present invention and is a circuit diagram showing a circuit configuration of a liquid crystal display device, a configuration of which is different from that of FIG. 1.

DESCRIPTION OF THE EMBODIMENTS

The following will explain one embodiment of the present invention with reference to drawings.

FIG. 1 shows a circuit configuration of a liquid crystal display device according to the present embodiment. As shown in FIG. 1, the liquid crystal display device includes, within a display panel 101, scanning lines 111-1 to **111-*n* and signal lines 121-1 to 121-*m* disposed in a lattice state, and a liquid crystal pixel 132 connected at a crossing point of a scanning electrode and a signal electrode via a pixel TFT 131. Further, with respect to the scanning lines 111-1 to 111-*n* and the signal lines 121-1 to 121-*m* are respectively connected a scanning electrode driving IC 112 and a signal electrode driving IC 122**.

Further, on one side of the display panel 101 closer to the scanning electrode driving IC 112, the scanning lines 111-1 to 111-*n* are respectively connected with scanning auxiliary lines 113-1 to 113-*n* having smaller wiring resistance and allowing less growth of a dull signal (smaller signal delay) than the scanning lines 111. Note that, the reason why the signal delay is small in the scanning auxiliary lines 113-1 to 113-*n* is that they do not have TFTs and auxiliary capacitors provided thereon, unlike the scanning lines 111-1 to 111-*n*.

One end of the scanning auxiliary lines 113-1 to 113-*n* is connected to the scanning lines 111-1 to 111-*n* at a portion closer to an input end (on the side closer to the scanning electrode driving IC) than the pixel TFTs 131 to be connected with the scanning lines 111, and the other end is connected to respective gate electrodes of charging TFTs 114-1 to 114-*n*, each of which is provided for each scanning line 111. In addition, a source electrode of each charging TFT 114 is connected to a scanning driving voltage power source 115 which supplies a scanning driving voltage of a selected period (hereinafter referred to as "selected state scanning driving voltage power source"), and a drain electrode is connected to the scanning lines 111-1 to 111-*n* at a portion closer to a termination end (on the side away from the scanning electrode driving IC) than the pixel TFTs 131 to be connected with the scanning lines 111.

Further, the termination end of the scanning lines 111 is connected to source electrodes of discharging TFTs 116-1 to 116-*n*, each of which is provided for each scanning line 111. The discharging TFTs 116 are connected to the scanning lines 111 so as to be in parallel with the charging TFTs 114. Respective drain electrodes of the discharging TFTs 116 are connected to a non-selected state scanning driving voltage power source 117, and gate electrodes are respectively connected to scanning auxiliary lines, each of which is provided with respect to a scanning line of the following stage. It should be noted that the scanning line 111-*n* that is the last line does not have a scanning line of the following stage, and therefore, the gate electrode of the discharging TFT 116-*n* is directly connected to the scanning electrode driving IC 112 via a scanning auxiliary line 113-(*n*+1). The scanning auxiliary line 113-(*n*+1) receives such a dummy pulse as to be turned ON when the last scanning line 111-*n* is turned OFF.

In the present embodiment, it is assumed that a polycrystal silicon TFT is adopted with respect to the charging TFTs 114 and the discharging TFTs 116. In addition, the selected state scanning voltage power source 115 applies a voltage equivalent of a selected state scanning electrode driving voltage of the scanning electrode driving IC 112 to a connection terminal of each of the charging TFTs 114. Likewise, the non-selected state scanning voltage power source 117 applies a voltage equivalent of a non-selected state scanning electrode driving voltage of the scanning electrode driving IC 112 to a connection terminal of each of the discharging TFTs 116. Two methods for forming the polycrystal silicon TFT include: (i) a method in which all TFTs in an active element board (i.e., the pixel TFTs 131 for switching pixels, the charging TFTs 114 and the discharging TFTs 116) are formed of an amorphous silicon TFT, thereafter polycrystallizing the charging TFTs 114 and the discharging TFTs 116 by applying them laser annealing; and (ii) a method for integrally forming all TFTs including the pixel TFTs 131 for switching pixels, altogether, out of a polycrystal silicon TFT.

Here, the charging TFTs 114 and the discharging TFTs 116 of the polycrystal silicon TFT all have such a transistor size that On resistance of a degree not more than a few kΩ is available.

Note that, the configuration as shown in FIG. 1 is of a case where scanning lines are scanned successively from an upper side of the drawing; in the case of performing scanning from a lower side of the drawing, connection may be made in the opposite line sequence.

Next, the operation of a liquid crystal display according to the present embodiment will be explained with reference to FIGS. 1 and 2.

Figure 2:
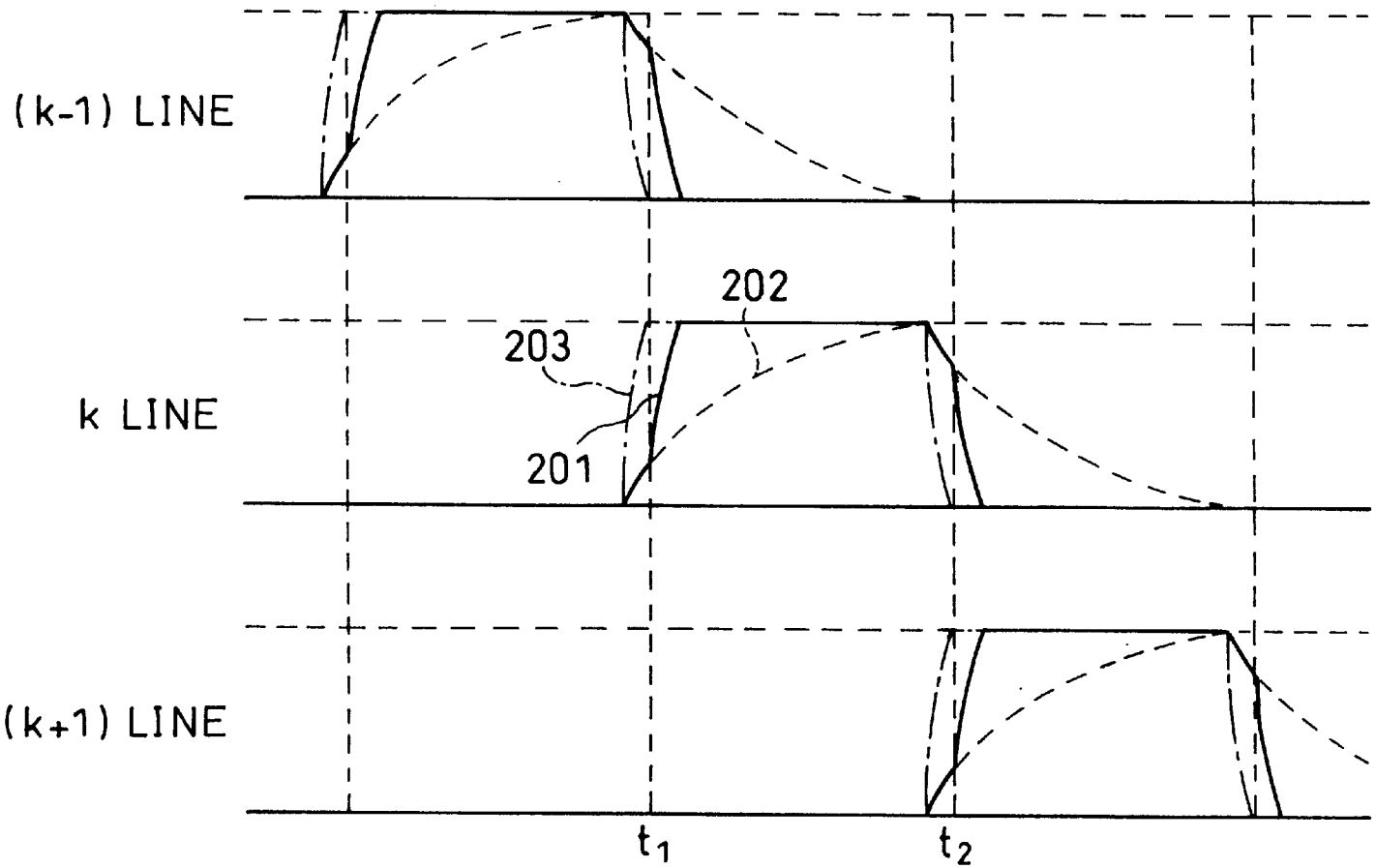
FIG. 2 is a timing chart showing a scanning voltage of the liquid crystal display device.

FIG. 2 is a timing chart of a scanning voltage in the liquid crystal display device, which shows waveforms of a scanning driving voltage to be applied to a gate of a TFT (termination side TFT) which is a pixel transistor provided most away from a connection terminal of the scanning electrode driving IC 112, a conventional configuration of which has a problem that a scanning driving voltage waveform grows dull.

In FIG. 2, the waveform of the scanning driving voltage waveform to be applied to the termination side TFT is, as indicated in the solid line in the drawing, takes the form as indicated by reference numeral 201. Further, in the conventional configuration, the waveform of the scanning driving voltage applied to the termination side TFT is, as shown in the broken line in the drawing, takes the form as indicated by reference numeral 202.

In the present embodiment, if focusing on a k-th scanning line (line k), the scanning driving voltage to be applied to the termination side TFT on the line k is first given by the scanning electrode driving IC via a scanning line 111-*k*. Therefore, the waveform of the scanning driving voltage of the termination side TFT has a dull rising characteristic, as with a conventional waveform, which is caused by wiring resistance and parasitic capacitance on the scanning line 111-*k* when starting scanning.

However, when the line k is selected, an ON signal given to the scanning line 111-*k* is applied to a gate electrode of a charging TFT 114-*k* simultaneously via a scanning auxiliary line 113-*k*, thereby also turning the charging TFT 114-*k* ON. Here, in the scanning auxiliary line, a signal delay is smaller than the scanning line because of no provision of a pixel transistor and a parasitic capacitance. Moreover, since the scanning auxiliary line is connected to each scanning line at a portion on the side of the input (the side closer to the scanning electrode driving IC), then an ON signal is offered to each scanning line and simultaneously to the charging TFT. Accordingly, the charging TFT 114-*k* exhibits a sharp rise of a waveform as indicated in the one-dot chain line of reference numeral 203 in FIG. 2, thereby being turned ON at time $t_1$. When the charging TFT 114-*k* is turned ON, the selected state scanning driving voltage power source 115 supplies a voltage equivalent of a selected state scanning electrode driving voltage of the scanning electrode driving IC 112 to the scanning line 111-*k* from the termination end of the scanning line 111-*k*. Consequently, after the charging TFT 114-*k* is turned ON, the termination side TFT exhibits a sharp rise, thereby improving a problem of the dull rise of the termination side TFT.

Next, a waveform at the fall of a scanning driving voltage to be applied to the termination side TFT will be explained.

When the scanning line on the line k 111-*k* is switched from a selected state to a non-selected state, the scanning driving voltage of the termination side TFT first exhibits a dull fall due to the adverse effect of the wiring resistance and parasitic capacitance of the scanning line 111-*k*, as in the case of the rise. However, when the scanning line on the line k 111-*k* is switched to the non-selected state, a scanning line on a line (k+1) is simultaneously switched to a selected state. When the scanning line 111-(*k*+1) is switched to the selected state, a scanning auxiliary line 113-(*k*+1) connected to the scanning line 111-(*k*+1) is given an ON voltage.

Here, the ON voltage to be supplied to the scanning auxiliary line 113-(*k*+1) not only causes a charging TFT on the line (k+1) 114-(*k*+1) to be turned ON but also is supplied to a gate electrode of a discharging TFT on the line k 116-*k* so as to cause it to be turned ON at time $t_2$. Thus allowing the discharging TFT 116-*k* to be turned ON causes the non-selected state scanning driving voltage power source 117 to supply the scanning line 111-*k* with a voltage equivalent of the non-selected scanning electrode driving voltage of the scanning electrode driving IC 112 from the termination end of the scanning line 111-*k*. Accordingly, after the discharging TFT 116-*k* is turned ON, the termination side TFT exhibits a sharp fall, thereby improving the dull fall of the termination side TFT.

As has been discussed, in the circuit configuration of the liquid crystal display device according to the present embodiment, an application of an ON voltage to the scanning auxiliary line on the line k 113-*k* causes the discharging TFT of the preceding stage, that is, on a line (k−1) 116-(*k*−1) to be turned ON so as to improve the fall of the termination side TFT of a scanning line 111-(k−1) and also causes the charging TFT of the same stage, that is, on the line k 114-*k* to be turned ON so as to improve the rise of the termination side TFT of the scanning line 111-*k*. This largely improves the rise and fall of a voltage when a scanning driving voltage of each of the scanning lines 111 is ON and OFF, respectively, compared to a waveform denoted by reference numeral 202 which is a scanning driving voltage according to prior art.

Note that, in an arrangement as shown in FIG. 1, a configuration including the charging TFTs 114 and the selected state scanning driving voltage power source 115 and a configuration including the discharging TFTs 116 and the non-selected state scanning driving voltage power source 117 are both provided with respect to the respective scanning lines 111 so as to improve both the rise of a scanning driving voltage when it is ON and the fall of the scanning driving voltage when it is OFF. However, each of these configurations is also effective when adopted individually. Therefore, the present invention may have an arrangement in which at least either one of these configurations is provided.

For example, FIG. 15 shows an arrangement in which the charging TFTs 114 and the selected state scanning driving voltage power source 115 are omitted, that is, only the discharging TFTs 116 and the non-selected state scanning driving voltage power source 117 are provided. In addition, in this arrangement, the scanning auxiliary line 113-1 is also omitted. It goes without saying that the present invention may alternatively have an arrangement in which the discharging TFTs 116 and the non-selected state scanning driving voltage power source are omitted.

FIGS. 3(*a*) and 3(*b*) show simulation waveforms of a voltage for comparing scanning driving voltage waveforms. More specifically, FIG. 3(*a*) shows a voltage waveform at the side of a connection terminal of the scanning electrode driving IC, and FIG. 3(*b*) shows a voltage waveform at the termination end of a scanning line in a conventional example. FIG. 3(*c*) shows a voltage waveform at the termination end of a scanning line in the present embodiment. As FIG. 3(*c*) clearly shows, the voltage waveform at the termination end of the scanning line according to the present embodiment exhibits an improvement in both of a voltage waveform when the voltage reaches a selected state voltage and a voltage waveform when the voltage reaches a non-selected state voltage, compared to the conventional example shown in FIG. 3(*b*).

Note that, explanation has been made above through the case where a polycrystal silicon TFT is adopted to form the charging TFTs 114 and the discharging TFTs 116; however, an amorphous silicon TFT may alternatively be adopted to form these TFTs.

The amorphous silicon TFT is inferior to the polycrystal silicon TFT in terms of driving performance. Therefore, when forming the charging TFTs 114 and the discharging TFTs 116 out of the amorphous silicon TFT, in order to reduce ON resistance in a transistor, it is necessary to set the size of the transistor as larger than the transistor of a pixel TFT as possible within the outer dimensions of a display panel.

Note that, when forming the charging TFTs 114 and the discharging TFTs 116 out of the amorphous silicon TFT, it is possible to integrally form these TFTs of the amorphous silicon TFT together with the pixel TFTs 131 for switching pixels, thereby attaining excellent cost efficiency.

Further, in the arrangement as explained, each of the scanning lines 111 has one each of the charging TFTs 114 and the discharging TFTs 116; however, a plurality of TFTs disposed in parallel with one another may alternatively be connected to each of the scanning lines 111. For example, as shown in FIG. 4(*a*), an arrangement in which a single TFT serves as both the charging TFT 114 and the discharging TFT 116 may be replaced with an arrangement as shown in FIG. 4(*b*), in which a plurality of TFTs are used.

In the case where a set of the single charging TFT 114 and the single discharging TFT 116 are connected to each of the scanning lines 111, it is feasible to impair an acceptable product ratio for the reasons that a transistor may be greatly upsized in accordance with the ON resistance of the transistor and the required amount of a signal delay, and/or there is no means to correct a defective transistor.

Consequently, as shown in FIG. 4(*b*), the above defect can be prevented by adopting an arrangement in which a plurality of TFTs each having an appropriate size are disposed in parallel with one another, that is advantageous in terms of performance and redundancy.

Meanwhile, FIG. 5 shows a modification example of the present invention, which has a circuit configuration different from that of FIG. 1. In a liquid crystal display device shown in FIG. 5, the selected state scanning driving voltage power source 115 and the non-selected state scanning voltage power source 117 shown in FIG. 1 are omitted, and lines 118 and 119 which are connected to respective source electrodes of the charging TFTs 114 and the discharging TFTs 116 are connected with the scanning electrode driving IC 112. In this arrangement, the scanning electrode driving IC 112 applies a selected state scanning driving voltage and a non-selected state scanning driving voltage to the charging TFTs 114 and the discharging TFTs 116.

The selected/non-selected state scanning driving voltage is equivalent of an output voltage of the scanning electrode driving IC 112. Therefore, costs can further be saved by providing arrangements corresponding to the selected state scanning driving voltage power source and the non-selected state scanning driving voltage power source with respect to the interior of the scanning electrode driving IC 112. Note that, operation in the case of the circuit configuration shown in FIG. 5 is the same as that in the case of the circuit configuration shown in FIG. 1.

Further, in the arrangement of FIG. 5, the selected state scanning driving voltage power source 115 and the non-selected state scanning driving voltage power source 117 are omitted, and the lines 118 and 119 which are connected to the source electrodes of the charging TFTs 114 and the discharging TFTs 116 are connected to the scanning electrode driving IC 112. However, the present invention may alternatively have an arrangement in which at least either one of the selected state scanning driving voltage power source 115 and the non-selected state scanning driving voltage power source 117 is omitted.

For example, FIG. 16 shows an arrangement in which the non-selected state scanning driving voltage power source 117 is omitted, and the line 119 to be connected to the source electrodes of the discharging TFTs 116 is connected to the scanning electrode driving IC 112. It goes without saying that the present invention may alternatively have an arrangement in which the selected state scanning driving voltage power source 115 is omitted, and the line 118 to be connected to the source electrodes of the charging TFTs 114 is connected to the scanning electrode driving IC 112.

Further, FIG. 6 shows another modification example of the present invention, which is different from FIG. 1. In a liquid crystal display device as shown in FIG. 6, the charging TFTs 114 and the discharging TFTs 116 are provided on a MOS transistor. Accordingly, the liquid crystal display device includes a display panel 301 and a charging/discharging circuit 302. In the display panel 301 are formed the pixel TFTs 131 for switching pixels, and the charging/discharging circuit 302 has the charging TFTs 114 and the discharging TFTs 116 on the MOS transistor.

In the charging/discharging circuit 302, the charging TFTs 114 and the discharging TFTs 116 are formed on a single crystal silicon board, and the charging/discharging circuit 302 which is a MOS transistor array chip is connected to the display panel 301 by a flexible board such as TCP (tape carrier package), COG (chip on glass), or the like, on the side opposite to the connection terminal with the scanning electrode driving IC 112. The scanning electrode driving IC 112 supplies a selected/non-selected state scanning driving voltage to the charging TFTs 114 and the discharging TFTs 116. Note that, as to the rest of circuit configuration and operation, the liquid crystal display device shown in FIG. 6 is the same as the liquid crystal display device of FIG. 5. However, any circuit configuration and operation of a liquid crystal display device shown in one of the other drawings such as FIG. 1 may alternatively be adopted.

In this liquid crystal display device, the MOS transistor array chip has the smaller number of elements than the scanning electrode driving IC, and therefore can be produced at a low cost, thus being manufactured at a lower cost than by a conventional double-side driving technique.

Further, FIG. 17 shows another modification example of the present invention, which is different from FIG. 1. A liquid crystal display device shown in FIG. 17 has an arrangement in which the charging TFTs 114 and the discharging TFTs 116 as discussed are not provided, but branch scanning lines 120 are provided. The branch scanning lines 120 allow smaller signal delay than the scanning lines 111 and branch off from one side of the scanning lines 111 to which signals are applied. The edge portions of the branch scanning lines 120 on the side opposite to the side to which signals are applied are connected to the scanning lines 111 from which they branched off. In addition, the branch scanning lines 120 are disposed adjacent to the scanning lines 111 to which they are connected, on the board to form the display panel 101.

With the arrangement of FIG. 17, the branch scanning lines 120 allow smaller signal delay than the scanning lines 111, and branch off from one side of the scanning lines 111 to which signals are applied, and the edge portions of the branch scanning lines 120 on the side opposite to the side to which signals are applied are connected to the scanning sires 111 from which they branched off, thereby making it possible to apply a scanning signal from the scanning electrode driving IC 112 to the scanning lines 111 via the termination side of the scanning lines 111, without causing a signal delay.

Consequently, it is possible to abruptly provide a scanning signal particularly to the pixel TFT 131 at the termination end of the scanning lines 111, thereby improving the dull waveform of a scanning driving voltage at rise and fall.

Further, the branch scanning lines 120 are disposed on a board on which the scanning lines 111 are formed, which are adjacent to the scanning lines 111 to which the branch scanning lines 120 are connected. Therefore, even in the case where an image display device has high resolution and the large number of scanning lines 111, the branch scanning lines can be readily provided without causing an increase in the number of components such as a connection board, unlike an arrangement (the arrangement of FIG. 13) in which the branch scanning lines are connected to the termination end of the scanning lines, first via upper and lower ends of a board, then via the connection board.

Further, as a modification example of FIG. 17, an arrangement as shown in FIG. 18 may be adopted. A liquid crystal display device of FIG. 18 includes branch scanning lines 120' which allow smaller signal delay than the scanning lines 111, branch off from one side of the scanning lines 111 to which signals are applied, and are connected to the edge portions of the scanning lines 111 on the side opposite to the side to which signals are applied, from which the branch scanning lines 120' branched off. In addition, the branch scanning lines 120' are disposed adjacent to the scanning lines 111 to which they are connected, on the board on which the display panel 101 is formed. Further, in this liquid crystal display device are provided the discharging TFTs 116 and the non-selected state scanning driving voltage power source 117.

With the arrangement of FIG. 18, when a scanning line 111 is switched from a selected state to a non-selected state, a scanning line 111 of the following stage is switched to the selected state. Therefore, the discharging TFT to be connected to the scanning line 111 switched from the selected state to the non-selected state is promptly arisen by an ON signal from the branch scanning line 120' of the following stage. This makes it possible to abruptly supply a non-selected state scanning driving voltage to the pixel TFT 131 at the termination end of the scanning line 111 switched from the selected state to the non-selected state, thereby further improving the dull waveform of a scanning driving voltage at the fall thereof.

In the arrangements of FIGS. 17 and 18, the branch scanning lines 120 and 120' are set to supply scanning signals from the scanning electrode driving IC 112 directly to the scanning lines 111 from the termination end of the scanning lines 111, thereby having a function different from that of the scanning auxiliary lines 113 to perform control of the charging TFTs 114 and the discharging TFTs 116 according to a scanning signal outputted from the scanning electrode driving IC 112. Note that, in the arrangement of FIG. 18, the branch scanning lines 120' simultaneously controls the discharging TFTs 116 by the scanning signal from the scanning electrode driving IC 112, thus also having the function of the scanning auxiliary line.

Thus, in the present embodiment, explanation has been made through the case where a liquid crystal display device is adopted. However, the present invention is equally applicable to any image display devices adopting an active matrix system such as an EL display device and the like, other than the liquid crystal display device.

As has been explained, an image display device according to the present invention is an active-matrix display device which has a plurality of scanning lines and a plurality of signal lines respectively disposed in directions to mutually intersect, and a plurality of display pixels disposed in a matrix, each of which is connected via a pixel switching element to each intersecting point where the lines intersect, the image display device including scanning auxiliary lines which are respectively provided to the scanning lines, the scanning auxiliary lines allowing smaller signal delay than the scanning lines, branching off from one side of the scanning lines to which signals are applied (the side which is connected to a scanning electrode driving circuit) and being connected to the scanning lines, and the image display device having at least one arrangement selected from the group consisting:

(i) an arrangement, wherein:

charging switching elements (TFTs, for example), each of which is connected to an edge portion of each of the scanning lines on a side opposite to the side to which the signals are applied, has a control terminal to which a scanning auxiliary line of the same stage as that of the connected scanning line is connected, and is controlled by a scanning signal of the same stage to be turned ON/OFF, and a selected state scanning driving voltage power source which supplies a selected scanning driving voltage to a scanning line which is connected to a termination end of the scanning lines (a side opposite to a side to which a scanning electrode driving circuit is connected) via a charging switching element in an ON state, from the termination end; and (ii) an arrangement, wherein:

discharging switching elements (TFTs, for example), each of which is connected to an edge portion of each of the scanning lines on a side opposite to the side to which signals are applied, has a control terminal to which a scanning auxiliary line of the following stage of the connected scanning line is connected, and is controlled by a scanning signal of the following stage whether to be turned ON/OFF, and a non-selected state scanning driving voltage power source which supplies a non-selected state scanning driving voltage to a scanning line which is connected to the termination end of the scanning lines via a discharging switching element in an ON state, from the termination end.

With this arrangement, each of the scanning lines is connected, at its termination end, to the selected state scanning driving voltage power source or the non-selected state scanning driving voltage power source via the charging or discharging switching element.

Further, in the arrangement having the charging switching element and the selected state scanning driving voltage power source, when one of the scanning lines is switched to a selected state, an ON scanning signal which is applied to the scanning line turns the charging switching element ON via the scanning auxiliary line. Accordingly, the selected state scanning driving voltage power source applies a selected state scanning driving voltage to the selected scanning line from its termination end. Here, since the scanning auxiliary line allows only small signal delay, the charging switching element promptly rises, and the selected state scanning driving voltage can also be applied abruptly to a pixel switching element at the termination end of the scanning lines in particular, thereby improving the dull waveform of the scanning driving voltage at rise.

Further, in the arrangement having the discharging switching element and the non-selected state scanning driving voltage power source, when one of the scanning lines is switched from a selected state to a non-selected state, a scanning line of the following stage is switched to the selected state. Therefore, one of the discharging switching elements having a control terminal connected to a scanning auxiliary line of the following stage promptly rises, and a non-selected state scanning driving voltage can be applied abruptly to a pixel switching element at the termination end of the scanning lines, thereby improving the dull waveform of the scanning driving voltage at fall.

Further, the image display device may have an arrangement in which a TFT is used to form the charging switching elements and/or the discharging switching elements, each of the charging switching elements has a gate electrode which is connected to the scanning auxiliary line of the same stage, and a source/drain electrode which is connected to the scanning line of the same stage and the selected state scanning driving voltage power source, and each of the discharging switching elements has a gate electrode which is connected to the scanning auxiliary line of the following stage, and a source/drain electrode which is connected to the scanning line of the same stage and the non-selected state scanning driving voltage power source.

With this arrangement, the charging and discharging switching elements can be formed on a board through the same manufacturing step of the display panel, thus suppressing an increase in costs.

Further, the image display device may have an arrangement in which polycrystal silicon is used to form a semiconductor layer of the TFT of each of the charging switching elements and/or the discharging switching elements.

With this arrangement, by thus having the charging and discharging switching elements of the polycrystal silicon TFT capable of high driving performance, even when a transistor is downsized, sufficient performance can be attained, thus contributing to the downsizing of a device.

Further, the image display device may have an arrangement in which amorphous silicon is used to form a semiconductor layer of the TFT of each of the charging switching elements and/or the discharging switching elements.

With this arrangement, by thus having the charging and discharging switching elements of the amorphous silicon TFT used for pixel switching elements, the charging and discharging switching elements can integrally be formed with the pixel switching elements, thereby attaining excellent cost efficiency.

Further, the image display device may have an arrangement in which the charging switching elements and/or the discharging switching elements are respectively arranged so that a plurality of TFTs are disposed in parallel with one another.

With this arrangement, it is possible to reduce ON resistance in the charging and discharging switching elements without excessively upsizing a transistor, thereby improving transistor performance and redundancy.

Further, the image display device may have an arrangement in which a MOS transistor is used to form the charging switching elements and/or the discharging switching elements, each of the discharging switching elements has a gate electrode which is connected to the scanning auxiliary line of the following stage, and a source/drain electrode which is connected to the scanning line of the same stage and the non-selected state scanning driving voltage power source, and the charging switching elements and/or the discharging switching elements are provided on a MOS transistor array chip which is different from a display panel, the MOS transistor array chip being connected to the display panel on a side opposite to a connection side of a scanning electrode driving circuit which supplies a scanning signal to each of the scanning lines.

With this arrangement, the MOS transistor array chip has the smaller number of elements than the scanning electrode driving circuit, and therefore can be produced at a low cost, thereby reducing the cost of a device.

Further, the image display device may have an arrangement in which the charging switching elements and/or the discharging switching elements are respectively arranged so that a plurality of MOS transistors are disposed in parallel with one another.

With this arrangement, it is possible to reduce ON resistance in the charging and discharging switching elements without excessively upsizing a transistor, thereby improving transistor performance and redundancy.

Further, the image display device may have an arrangement in which at least one of the selected state scanning driving voltage power source and the non-selected state scanning driving voltage power source is provided within a scanning electrode driving circuit which supplies a scanning signal to each of the scanning lines.

With this arrangement, since a selected/non-selected state scanning driving voltage is equivalent of an output voltage of the scanning electrode driving circuit, it is possible to further save costs by providing arrangements corresponding to the selected state scanning driving voltage power source and the non-selected state scanning driving voltage power source with respect to the interior of the scanning electrode driving circuit.

Further, an image display device differently configured according to the present invention is an active-matrix image display device having a plurality of scanning lines and a plurality of signal lines respectively disposed in directions to intersect with the other, and a plurality of display pixels disposed in a matrix, each of which is connected via a pixel switching element to each intersecting point where the lines intersect, the image display device includes: branch scanning lines which allow smaller signal delay than the scanning lines, branch off from one side of the scanning lines to which signals are applied, and are connected to the scanning lines from which they branched off at an edge portion on a side opposite to the side to which the signals are applied, the branch scanning lines being disposed adjacent to the scanning lines to which they are connected on a board on which the scanning lines are formed.

With this arrangement, the branch scanning lines allow smaller signal delay than the scanning lines, branch off from one side of the scanning lines to which signals are applied, and are connected to the scanning lines from which they branched off on an edge portion on the side opposite to the side to which the signals are applied, thereby making it possible to apply a scanning signal outputted from a scanning electrode driving IC from a termination end of the scanning lines without causing signal delay.

Accordingly, it is possible to supply a scanning signal abruptly to a pixel switching element at the termination end of the scanning signals in particular, thereby improving the dull waveform of a scanning driving voltage at both rise and fall.

Further, the branch scanning lines are disposed adjacent to the scanning lines to which they are connected on a board on which the scanning lines are formed. Therefore, even when the image display device has high resolution and the large number of the scanning lines, the branch scanning lines can be readily provided without causing an increase in the number of components such as a connection board, unlike an arrangement in which the branch scanning lines are connected to the termination end of the scanning lines, first via upper and lower ends of the board, then via the connection board.

Further, the image display device may have an arrangement further including: discharging switching elements, each of which is connected to an edge portion of each of the scanning lines on a side opposite to the side to which signals are applied, has a control terminal to which a scanning auxiliary line of the following stage of the connected scanning line is connected, and is controlled by a scanning signal of the following stage whether to be turned ON/OFF; and a non-selected state scanning driving voltage power source which supplies a non-selected state scanning driving voltage to a scanning line which is connected to a termination end of the scanning lines via a discharging switching element in an ON state, from the termination end.

With this arrangement, when the scanning lines are switched from a selected state to a non-selected state, the scanning line of the following stage is switched to the selected state. Therefore, the discharging switching element having the control terminal which is connected to the branch scanning line of the following stage promptly rises, and a non-selected scanning driving voltage can abruptly be supplied to a pixel switching element at the termination end of the scanning lines, thereby further improving the dull waveform of a scanning driving voltage at fall.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An active-matrix image display device including a plurality of scanning lines, a plurality of signal lines, the signal lines and scanning lines being respectively disposed in directions to mutually intersect, a plurality of pixel switching elements, and a plurality of display pixels disposed in a matrix, each of which is connected via one of the plurality of pixel switching elements to each intersecting point where the lines intersect, the image display device comprising:

a plurality of scanning auxiliary lines, each being characterized as allowing smaller signal delay than the scanning lines, wherein each of the scanning auxiliary lines is connected to a portion of a corresponding one of the plurality of scanning lines and arranged so as to branch off from the scanning line it is connected to, the scanning line portion being on a side of the scanning line to which signals are applied, wherein the image display device further comprises at least one arrangement selected from the group consisting:

a first arrangement including a plurality of charging switching elements and a selected state scanning driving voltage power source, wherein:

each of the charging switching elements includes control terminal and is connected to an edge portion of each of the scanning lines, the edge portion being opposite to the side to which the signals are applied, wherein the control terminal is connected to the scanning auxiliary line of the corresponding scanning line of a stage, and is controlled by a scanning signal to the corresponding scanning line of the same stage so as to turn the respective charging element of the same stage ON/OFF, and the selected state scanning driving voltage power source is operably coupled to the charging switching elements such that when the respective charging element of the same stage is in an ON state, a selected scanning driving voltage is applied to a terminal end of the corresponding scanning line via the edge portion and via the respective charging element of the same stage; and a second arrangement including a plurality of discharging switching elements and a non-selected state scanning driving voltage power source, wherein:

each of the discharging switching elements is connected to an edge portion of each of the scanning lines on a side opposite to the side to which signals are applied, and includes a control terminal, wherein the scanning line and scanning auxiliary line of the same stage and the scanning line and scanning auxiliary line of a following stage are arranged so the control terminal of the respective discharge switching element of the same stage is connected to the scanning auxiliary line of the following stage, and so the respective discharge element of the same stage is controlled by a scanning signal to the scanning line of the following stage, and so as to turn the respective discharge switching element of the same stage ON/OFF, the non-selected state scanning driving voltage power source is operably coupled to the plurality of discharge switching elements such that when the respective discharge switching element of the same stage is in an ON state, a non-selected state scanning driving voltage is applied to the termination end of the scanning lines via the edge portion and the respective discharging switching element of the same stage.

2. The image display device as set forth in claim 1, wherein:

a TFT is used to form the charging switching elements and/or the discharging switching elements respectively of the first and second arrangments, each of the charging switching elements includes a gate electrode that is connected to the scanning auxiliary line of the same stage, and a source/drain electrode which is connected to the edge portion of the scanning line of the same stage and to the selected state scanning driving voltage power source, and each of the discharging switching elements includes gate electrode that is connected to the scanning auxiliary line of the following stage, and a source/drain electrode which is connected to the edge portion of the scanning line of the same stage and to the non-selected state scanning driving voltage power source.

3. The image display device as set forth in claim 2, wherein:

polycrystal silicon is used to form a semiconductor layer of the TFT of each of the charging switching elements and/or the discharging switching elements.

4. The image display device as set forth in claim 2, wherein:

amorphous silicon is used to form a semiconductor layer of the TFT of each of the charging switching elements and/or the discharging switching elements.

5. The image display device as set forth in claim 2, wherein:

the charging switching elements and/or the discharging switching elements are respectively arranged so that a plurality of TFTs are disposed in parallel with one another.

6. The image display device as set forth in claim 1, wherein:

a MOS transistor is used to form the charging switching elements and/or the discharging switching elements respectively of the first and second arrangements, each of the charging switching elements includes a gate electrode that is connected to the scanning auxiliary line of the same stage, and a source/drain electrode that is connected to the edge portion of the scanning line of the same stage and to the selected state scanning driving voltage power source, each of the discharging switching elements includes a gate electrode that is connected to the scanning auxiliary line of the following stage, and a source/drain electrode which is connected to the edge portion of the scanning line of the same stage and to the non-selected state scanning driving voltage power source, and the charging switching elements and/or the discharging switching elements are provided on a MOS transistor array chip that is different from a display panel, the MOS transistor array chip being connected to the display panel on a side opposite to a connection side of a scanning electrode driving circuit which supplies a scanning signal to each of the plurality of scanning lines.

7. The image display device as set forth in claim 6, wherein:

the charging switching elements and/or the discharging switching elements are respectively arranged so that a plurality of MOS transistors are disposed in parallel with one another.

8. The image display device as set forth in claim 1, wherein:

at least one of the selected state scanning driving voltage power source and the non-state scanning driving voltage power source is provided within a scanning electrode driving circuit which supplies a scanning signal to each of the scanning lines.

9. An active-matrix image display device including a plurality of scanning lines, a plurality of signal lines where the scanning lines and the signal lines are respectively disposed in directions to mutually intersect, a plurality of pixel switching elements and a plurality of display pixels disposed in a matrix, each of which is connected via one of the plurality of pixel switching element to each intersecting point where the lines intersect, the image display device comprising:

a plurality of branch scanning lines which allow smaller signal delay than the scanning lines, each branch scanning line being arranged so as to branch off from one side of the scanning lines to which signals are applied, and so as to connect to another side of the scanning lines from which they branched off at an edge portion of the another side, the another side being opposite to the side to which the signals are applied, a board on which the plurality of scanning lines and the plurality of branch scanning lines are formed, wherein the branch scanning lines are disposed adjacent to the scanning lines to which they are connected on the board.

10. The image display device as set forth in claim 9, further comprising:

a plurality of discharging switching elements, each having a control terminal and each being connected to an edge portion of each of the scanning lines on a side opposite to the side to which scanning signals are applied, wherein the control terminal of a respective discharge switching element of a same stage is connected to a branch scanning line of the following stag so that the respective discharging switching element of the same stage is controlled by a scanning signal applied to the scanning line of the following stage so as to be turned ON/OFF; and a non-selected state scanning driving voltage power source being operably coupled to the plurality of discharge switching elements such that when the respective discharge switching element of the same stage is in an ON state a non-selected state scanning driving voltage is supplied to a termination end of the scanning line of the same stage via the respective discharge switching element of the same stage.

11. The image display device as set forth in claim 10, wherein:

a TFT is used to form each of the discharge switching elements, and polycrystal silicon is used to form a semiconductor layer of a TFT of each of the discharging switching elements.

12. The image display device as set forth in claim 10, wherein:

a TFT is used to form each of the discharge switching elements, and amorphous silicon is used to form a semiconductor layer of a TFT of each of the discharging switching elements.

13. The image display device as set forth in claim 10, wherein:

a TFT is used to form each of the discharge switching elements, and each of the discharging switching elements is arranged so that a plurality of TFTs are disposed in parallel with one another.

14. The image display device as set forth in claim 10, wherein:

the non-selected state scanning driving voltage power source is provided within a scanning electrode driving circuit which supplies a scanning signal to each of the scanning lines.

15. An active-matrix image display device including a plurality of scanning lines, a plurality of signal lines, the signal lines and scanning lines being respectively disposed in directions to mutually intersect, a plurality of pixel switching elements, and a plurality of display pixels disposed in a matrix, each of which is connected via one of the plurality of pixel switching elements to each intersecting point where the lines intersect, the image display device comprising:

scanning auxiliary lines which are respectively provided to the scanning lines, the scanning auxiliary lines allowing smaller signal delay than the scanning lines, branching off from one side of the scanning lines to which signals are applied and being connected to the scanning lines, wherein the image display device further comprises at least one arrangement selected from the group consisting:

a first arrangement including charging switching elements and a selected state scanning driving voltage power source, wherein:

each of the charging switching elements is connected to an edge portion of each of the scanning lines on a side opposite to the side to which the signals are applied, has a control terminal to which a scanning auxiliary line of the same stage as that of the connected scanning line is connected, and is controlled by a scanning signal of the same stage whether to be turned ON/OFF, and the selected state scanning driving voltage power source supplies a selected scanning driving voltage to a scanning line which is connected to a termination end of the scanning lines via a charging switching element in an ON state, from the termination end; and a second arrangement including discharging switching elements and a non-selected state scanning driving voltage power source, wherein:

each of the discharging switching elements is connected to an edge portion of each of the scanning lines on a side opposite to the side to which signals are applied, has a control terminal to which a scanning auxiliary line of the following stage of the connected scanning line is connected, and is controlled by a scanning signal of the following stage whether to be turned ON/OFF, the non-selected state scanning driving voltage power source supplies a non-selected state scanning driving voltage to a scanning line which is connected to the termination end of the scanning lines via a discharging switching element in an ON state, from the termination end; and wherein a MOS transistor is used to form the charging switching elements and/or the discharging switching elements, wherein each of the charging switching elements includes a gate electrode that is connected to the scanning auxiliary line of the same stage, and a source/drain electrode that is connected to the edge portion of the scanning line of the same stage and to the selected state scanning driving voltage power source, wherein each of the discharging switching elements includes a gate electrode that is connected to the scanning auxiliary line of the following stage, and a source/drain electrode which is connected to the edge portion of the scanning line of the same stage and to the non-selected state scanning driving voltage power source, and wherein the charging switching elements and/or the discharging switching elements are provided on a MOS transistor array chip that is different from a display panel, the MOS transistor array chip being connected to the display panel on a side opposite to a connection side of a scanning electrode driving circuit which supplies a scanning signal to each of the plurality of scanning lines.

16. The image display device as set forth in claim 15, wherein:

the charging switching elements and/or the discharging switching elements are respectively arranged so that a plurality of MOS transistors are disposed in parallel with one another.

17. An active-matrix image display device including a plurality of scanning lines, a plurality of signal lines, the signal lines and scanning lines being respectively disposed in directions to mutually intersect, a plurality of pixel switching elements, and a plurality of display pixels disposed in a matrix, each of which is connected via one of the plurality of pixel switching elements to each intersecting point where the lines intersect, the image display device comprising:

scanning auxiliary lines which are respectively provided to the scanning lines, the scanning auxiliary lines allowing smaller signal delay than the scanning lines, branching off from one side of the scanning lines to which signals are applied and being connected to the scanning lines, wherein the image display device further comprises at least one arrangement selected from the group consisting:

a first arrangement including charging switching elements and a selected state scanning driving voltage power source, wherein:

each of the charging switching elements is connected to an edge portion of each of the scanning lines on a side opposite to the side to which the signals are applied, has a control terminal to which a scanning auxiliary line of the same stage as that of the connected scanning line is connected, and is controlled by a scanning signal of the same stage whether to be turned ON/OFF, and the selected state scanning driving voltage power source supplies a selected scanning driving voltage to a scanning line which is connected to a termination end of the scanning lines via a charging switching element in an ON state, from the termination end; and a second arrangement including discharging switching elements and a non-selected state scanning driving voltage power source, wherein:

each of the discharging switching elements is connected to an edge portion of each of the scanning lines on a side opposite to the side to which signals are applied, and has a control terminal to which is connected to the scanning auxiliary line of the following stage, and is controlled by a scanning signal of the following stage whether to be turned ON/OFF, the non-selected state scanning driving voltage power source supplies a non-selected state scanning driving voltage to a scanning line which is connected to the termination end of the scanning lines via a discharging switching element in an ON state, from the termination end.

* * * * *